US006076046A

United States Patent [19]

Vasudevan et al.

[11] Patent Number: 6,076,046

[45] Date of Patent: Jun. 13, 2000

[54] POST-CLOSURE ANALYSIS IN HYDRAULIC FRACTURING

[75] Inventors: Sriram Vasudevan, Stafford, Tex.; Kenneth G. Nolte, Tulsa, Okla.; Jerome Maniere, Sugar Land, Tex.

[73] Assignee: Schlumberger Technology Corporation, Sugar Land, Tex.

[21] Appl. No.: 09/122,451

[22] Filed: Jul. 24, 1998

[51] Int. Cl.[7] ..... G06F 19/00

[52] U.S. Cl. ..... 702/12; 166/250.08

[58] Field of Search ..... 702/12, 13; 166/250.1, 166/250.08, 308

[56] References Cited

U.S. PATENT DOCUMENTS

| | | |
|---|---|---|
| 3,059,909 | 10/1962 | Wise . |
| 3,301,723 | 1/1967 | Chrisp . |
| 3,888,312 | 6/1975 | Tiner et al. . |
| 4,725,372 | 2/1988 | Teot et al. . |
| 5,050,674 | 9/1991 | Soliman . |
| 5,258,137 | 11/1993 | Bonekamp et al. . |
| 5,305,211 | 4/1994 | Soliman . |
| 5,551,516 | 9/1996 | Norman et al. . |

OTHER PUBLICATIONS

SPE 50611 "Enhanced Calibration Treatment Analysis for Optimizing Fracture Performane: Validation and Field Examples", Gulrajani, et al, (to be published in Oct. 1998).

SPE 39407 "Background for After–Closure Analysis of Fracture Calibration Tests", Nolte, Jul., 1997.

SPE 38676 "After–Closure Analysis of Fracture Calibration Tests", Nolte, et al, Oct., 1997.

SPE 25845 A Systematic Method of Applying Fracturing Pressure Decline: Part 1, (1993).

Carslaw, H.S., Conduction of Heat in Solids, 2nd Ed. Oxford University Press (1959), p. 76.

*Primary Examiner*—Donald E. McElheny, Jr.
*Attorney, Agent, or Firm*—Douglas Y'Barbo; Robin C. Nava

[57] ABSTRACT

Methods and processes are claimed for optimal design of hydraulic fracturing jobs, and in particular, methods and processes for selecting the optimal amount of proppant-carrying fluid to be pumped into the fracture (which is a crucial parameter in hydraulic fracturing) wherein these design parameters are obtained, ultimately from a priori formation/rock parameters, from pressure-decline data obtained during both linear and radial flow regimes, and by analogy with a related problem in heat transfer, in addition the claimed methods and processes also include redundant verification means.

55 Claims, 25 Drawing Sheets

POST-CLOSURE ANALYSIS IN HYDRAULIC FRACTURING

BACKGROUND OF THE INVENTION

1. Technical Field of the Invention

The present Invention relates to hydrocarbon well stimulation, and more particularly to methods and processes for optimal design of hydraulic fracturing jobs, and in particular, to methods and processes for selecting the optimal amount of proppant-carrying fluid to be pumped into the fracture (which is a crucial parameter in hydraulic fracturing) wherein these design parameters are obtained, ultimately from a priori formation/rock parameters, from pressure-decline data obtained during both linear and radial flow regimes, and by analogy with a related problem in heat transfer.

2. The Prior Art

The present Invention relates generally to hydrocarbon (petroleum and natural gas) production from wells drilled in the earth. Obviously, it is desirable to maximize both and the overall recovery of hydrocarbon held in the formation and the rate of flow from the subsurface formation to the surface, where it can be recovered. One set of techniques to do this is referred to as stimulation techniques, and one such technique, "hydraulic fracturing," is the subject of the present Invention. The rate of flow, or "production" of hydrocarbon from a geologic formation is naturally dependent on numerous factors. One of these factors is the radius of the borehole. As the radius of the borehole increases, the production rate increases, everything else being equal. Another factor, related to the first, is the flowpaths available to the migrating hydrocarbon.

Drilling a hole in the subsurface is expensive—which limits the number of wells that can be economically drilled—and this expense only generally increases as the size of the hole increases. Additionally, a larger hole creates greater instability to the geologic formation, thus increasing the chances that the formation will shift around the wellbore and therefore damage the wellbore (and at worse collapse). So, while a larger borehole will, in theory, increase hydrocarbon production, it is impractical, and there is a significant downside. Yet, a fracture or large crack within the producing zone of the geologic formation, originating from and radiating out from the wellbore, can actually increase the "effective" (as opposed to "actual") wellbore radius, thus, the well behaves (in terms of production rate) as if the entire wellbore radius were much larger.

Fracturing (generally speaking, there are two types, acid fracturing and propped fracturing, the latter is of primary interest here) thus refers to methods used to stimulate the production of fluids resident in the subsurface, e.g., oil, natural gas, and brines. Hydraulic fracturing involves literally breaking or fracturing a portion of the surrounding strata, by injecting a specialized fluid into the wellbore directed at the face of the geologic formation at pressures sufficient to initiate and/or extend a fracture in the formation. More particularly, a fluid is injected through a wellbore; the fluid exits through holes (perforations in the well casing) and is directed against the face of the formation at a pressure and flow rate sufficient to overcome the in situ stress (a.k.a. the "minimum principal stress) and to initiate and/or extend a fracture(s) into the formation. Actually, what is created by this process is not always a single fracture, but a fracture zone, i.e., a zone having multiple fractures, or cracks in the formation, through which hydrocarbon can more readily flow to the wellbore.

In practice, fracturing a well is a highly complex operation performed with the exquisite orchestration of over a dozen large trucks, roughly the same number of highly skilled engineers the technicians, a mobile laboratory for real-time quality assurance, and powerful integrated computers that monitor pumping rates, downhole pressures, etc. During a typical fracturing job, over 350,000 pounds of fluid will be pumped at extraordinarily high pressures (exceeding the minimum principal stress) down a well, to a pinpoint location, often thousands of feet below the earth's surface. Moreover, during the fracturing process, constant iterations of fluid level, pumping rates, and pumping times are performed in order to maximize the fracture zone, and minimize the damage to the formation.

A typical fracture zone is shown in context, in FIG. 1. The actual wellbore—or hole in the earth into which pipe is placed through which the hydrocarbon flows up from the hydrocarbon-bearing formation to the surface—is shown at 10, and the entire fracture zone is shown at 20. The vertical extent of the hydrocarbon-producing zone is ideally (though not generally) coextensive with the fracture-zone height (by design). These two coextensive zones are shown bounded by 22 and 24. The fracture is usually created in the producing zone of interest (rather than another geologic zone) because holes or perforations, 26–36, are deliberately created in the well casing beforehand; thus the fracturing fluid flows vertically down the wellbore and exits through the perforations.

Typically, creating a fracture in a hydrocarbon-bearing formation requires a complex suite of materials. Most often, four crucial components are required: a carrier fluid, a viscosifier, a proppant, and a breaker. A fifth component is sometimes added, whose purpose is to control leak-off, or migration of the fluid into the fracture face. Roughly, the purpose of the first component is to first create/extend the fracture, then once it is opened enough, to deliver proppant with time varying concentrations into the fracture, which keeps the fracture from closing once the pumping operation is completed. A first fluid termed as pad fluid is injected, and actually creates/extends the fracture. Then carrier fluid together with proppant material is injected into the fractured formation. The carrier fluid is simply the means by which the proppant and breaker are carried into the formation. It should be noted that the pad fluid may or may not be the same as the carrier fluid. Numerous substances can act as a suitable carrier fluid, though they are generally aqueous-based solutions that have been either gelled or foamed (or both). Thus, the carrier fluid is often prepared by blending a polymeric gelling agent with an aqueous solution (sometimes oil-based, sometimes a multi-phase fluid is desirable); often, the polymeric gelling agent is a solvatable polysaccharide, e.g., galactomannan gums, glycomannan gums, and cellulose derivatives. The purpose of the solvatable (or hydratable) polysaccharides is to thicken the aqueous solution so that solid particles known as "proppant" (discussed below) can be suspended in the solution for delivery into the fracture. Thus the polysaccharides function as viscosifiers, that is, they increase the viscosity of the aqueous solution by 10 to 100 times, or even more. During high temperature applications, a cross-linking agent is further added which further increases the viscosity of the solution. The borate ion has been used extensively as a crosslinking agent for hydrated guar gums and other galactomannans to form aqueous gels, e.g., U.S. Pat. No. 3,059,909. Other demonstrably suitable cross-linking agents include: titanium (U.S. Pat. No. 3,888,312), chromium, iron, aluminum, and zirconium (U.S. Pat. No. 3,301,723). More recently, viscoelastic surfactants have been developed which obviates the need for thickening agents, and hence cross-linking agents, see, e.g., U.S. Pat. No. 5,551,516; U.S. Pat. No. 5,258,137; and U.S. Pat. No. 4,725,372, all assigned/licensed to Schlumberger Dowell.

The purpose of the proppant is to keep the newly fractured formation in that fractured state, i.e., from re-closing after the fracturing process is completed; thus, it is designed to keep the fracture open—in other words to provide a permeable path for the hydrocarbon to flow through the fracture and into the wellbore. More specifically, the proppant provides channels within the fracture through which the hydrocarbon can flow into the wellbore and therefore be withdrawn or "produced." Typical material from which the proppant is made includes sand (e.g. 20–40 mesh), bauxite, synthetic materials of intermediate strength, and glass beads. The proppant can also be coated with resin to help prevent proppant flowback in certain applications. Thus, the purpose of the fracturing fluid generally is two-fold: (1) to create or extend an existing fracture through high-pressure introduction into the geologic formation of interest; and (2) to simultaneously deliver the proppant into the fracture void space so that the proppant can create a permanent channel through which the hydrocarbon can flow to the wellbore. Once this second step has been completed, it is desirable to remove the fracturing fluid from the fracture—its presence in the fracture is deleterious, since it plugs the fracture and therefore impedes the flow hydrocarbon. This effect is naturally greater in high permeability formations, since the fluid can readily fill the (larger) void spaces. This contamination of the fracture by the fluid is referred to as decreasing the effective fracture length. And the process of removing the fluid from the fracture once the proppant has been delivered is referred to as "fracture clean-up." For this, the final component of the fracture fluid becomes relevant: the breaker. The purpose of the breaker is to lower the viscosity of the fluid so that it is more easily removed fracture.

Thus, once the well has been drilled, fractures are often deliberately introduced in the formation, as a means of stimulating production, by increasing the effective wellbore radius. The crucial parameters in any hydraulic fracturing job—indeed, perhaps the most important parameters—are the amount of pad fluid and the proppant schedule. The consequences of using too little or too much are severe, and may dramatically affect well performance. If too little pad fluid is used the fracture will not propagate—this is undesirable for obvious reasons. Again, the goal is to achieve the largest possible fracture to fully exploit the drainage basin.

And yet using too much pad fluid—relative to the amount of proppant—is also undesirable. Again, the goal is to create a very large fracture; however, propagating a fracture by injecting fluid into the formation is of nominal value unless that fracture is fully loaded with proppant, otherwise it will immediately close up. In other words, the fracturing fluid, as it is extends the fracture, must carry with it sufficient proppant at that fracture frontier, otherwise, the fracture will simply close up once the fracturing fluid has leaked off into the formation. Therefore, one way to view the deleterious effect of too much fracturing fluid is that it results in a very dilute fracturing fluid-proppant mixture. Thus, as the fluid propagates the fracture, it leaves relatively little proppant in place to keep the fracture open. Put another way, too much fluid causes the fracture front migrate in advance of the proppant front. If the proppant does not plug the tip as it is created by the advancing fluid front, then this portion of the fracture will just close up, as if it were never created.

Therefore, selecting the precise amounts of fracturing fluid and proppant, and the precise ratio of the two, is of extraordinary importance to optimal fracture design, and therefore to overall hydrocarbon production from that reservoir.

The primary objective of the present Invention is optimizing fracture design. "Fracture design" refers to selecting the ideal amounts of fracturing fluid and proppant to pump into the formation. These ideal amounts are highly sensitive to formation parameters, as well as the fracturing fluid type, thus, they need to be selected for each fracturing job separately. When fracturing fluid is pumped into a fracture, it (heuristically) does two things. One, it propagates the fracture. And two, it leaks off into the surrounding formation. The leak-off rate—which is a function of the pumping pressures, the formation geology (i.e., rock type) and the type of fracturing fluid used—is an absolutely crucial parameter for proper fracture design. The reason is that the more fluid that leaks off that occurs, the more fluid that must be pumped into the formation to propagate the fracture. Therefore, in order to design a proper fracture job—that is, how much fracturing fluid to use—one needs to know how much of the fluid (and at what rate) that is pumped into the formation, will be lost into the formation. Thus, the leak-off rate—which again, is unique to a particular formation, and depends upon the type of fluid—is of crucial importance in fracture design. Indeed, the first step in a fracturing job is typically a calibration test, from which the engineer ultimately determines the amount of fracturing fluid to use in the fracturing job.

Leak-off is conceptually separable into two types: Carter leak-off and spurt. FIG. 2 is a cross-sectional view showing certain features of an ordinary fracture. The arrows are flow lines showing the flow path of fracturing fluid from the fracture into the formation. The flow lines represented as 30–38 are more or less perpendicular to the direction of fracture propagation; leak off in this direction is known as "Carter leak-off." (Carter leak-off need not be solely perpendicular, though). The flow lines represented as as 40–48 depict the second type of leak-off, known as "spurt." As evidenced by FIG. 2, this type of leak off occurs right at the fracture frontier. The fluid loss due to spurt accounts for a substantial portion of the fluid loss in cases where a filter case if formed due to pumping crosslinked gel in a high permeability formation.

Depending upon the formation geology (i.e., rock type) spurt can comprise the overwhelming fraction of the total leak-off (compared with Carter leak-off). For instance, in loose unconsolidated formations (>1 Darcy), the skilled engineer would more than likely select a cross-linked hydroxy propyl guar with borate ion gel which would form a tight, quickly forming, nearly impermeable filter cake over the formation face opposing the fracture, in order to prevent fracturing fluid leak-off in the subsequent step of the process—i.e, fracturing fluid carrying the proppant is pumped into the fracture. In this scenario, Carter leak-off is substantially diminished due to the filter cake, thus the majority of the fluid loss occurs via spurt. (In contrast water-based fracturing fluids such as an aqueous solution of KCl, used in low permeability formations, do not cause wall building and therefore, very little leak off is attributable to spurt in these circumstances).

And yet, despite the importance of a precise knowledge of leak-off to proper fracture design, and despite the significant contribution to total leak-off from spurt, no satisfactory method exists for determining the amount of fracturing fluid loss from spurt. The only satisfactory fluid-loss estimation techniques involve determining Carter leak off; these rely upon rough non-analytical estimations of spurt (often mere guesses). Indeed, most minifrac analysis techniques ignore the effect of spurt loss—even though it may comprise the greater source of fluid loss among the two possible sources.

The first attempt to consider spurt loss was presented in K. G. Nolte, *A General Analysis of Fracturing Pressure Decline With Application to Three Models,* SPE Formation Evaluation, December 1986, p. 571–83. Yet no objective, reproducible system to determine this parameter is available in the state-of-the art. Years later, M. Y. Souliman, in U.S. Pat. No. 5,305,211, assigned to Halliburton, presented a numerical technique for determining spurt loss. Despite its identical goal, the method presented in '211 differs in several substantial respect from the present Invention. More precisely, the present Invention differs from the '211 patent with respect to fundamental concept, physical steps to determine spurt, the techniques following spurt determination, and the accuracy and applicability of the technique.

The present Invention discloses and claims a method for determining spurt from the effect of this fluid-loss mechanism on linear flow slope. Thus a suitable theoretical model is constructed in which fluid loss occurs, in the absence of spurt. The results from this theoretical model are then compared with the normalized real-world data (i.e., fluid loss occurs both due to Carter leak-off and spurt) to obtain a correction that accounts for fluid loss due to spurt. By contrast, the method of the '211 patent determines spurt from closure time. In fact, the '211 patent actually teaches away, or would inevitably discourage one from considering the present Invention: e.g., "Consequently, pressure decline with time following shut-in will yield no information on spurt loss." (c. 6, 1. 20). Thus, the '211 patent relies on closure time to determine spurt—e.g., a higher spurt loss will naturally lead to a lower closure time. According to the '211 patent, the discrepancy between the closure time that would have been observed in the absence of filter cake formation on the fracture face (due to fluid leak-off) and the actual or observed closure time (in the presence of spurt) is used to deduce spurt. Embedded in this methodology is the assumption that the difference between ideal and observed closure time is due solely to spurt. In fact, factors other than spurt may substantially affect closure time, e.g., a change in fracture area after shut-in.

In addition, the present Invention is based on a combination of reservoir-based and fracture-based parameters. Therefore, the method/process of the present Invention requires a two-step approach: a first and a second injection event. Thus, the reservoir fluid-loss coefficient (a function of reservoir mobility) is determined from a first injection event (from which radial flow-based parameters are obtained) for later use in conjunction with linear flow slope and closure parameters obtained during the second-injection event (from which linear flow-based parameters are obtained).

Third, the present Invention also differs from the '211 patent with respect to the post-spurt determination—i.e., how the parameter is applied. In the present Invention, a single mathematical relationship relates linear flow slope, leak-off coefficient, closure pressure, reservoir pressure, and reservoir fluid-loss coefficient, to obtain spurt. Following a determination of spurt, one aspect of the present Invention teaches that the fracture length then be determined from several a priori reservoir parameters and other parameters already obtained (during both first and second injection events) in accordance with the present Invention. One purpose of determining fracture length is that it helps compare a reservoir-based estimate with the model (of the present Invention) estimate. From this comparison, an accurate estimate of fracture compliance can be obtained, therefore further ameliorating model-dependent error. By contrast in the approach taught in the '211 patent, spurt is determined by simultaneously solving a system of five equations. Yet the equations are dependent on a particular fracture-geometry model, and no independent validation exists.

Finally, the method/process disclosed and claimed here is likely to be more accurate than that taught in the '211 patent. Again, one reason is that model dependence is reduced since the present Invention subsumes numerous independent validation, and cross-validation means (e.g., through fracture-dimension comparison). In addition, the method/process of the present Invention is less sensitive to the estimate of closure parameters—again, the '211 patent depends upon them entirely. The present Invention teaches using reservoir parameters in synergy with linear flow-based parameters, rather than rely solely upon fracture closure.

Thus, in contrast to the present Invention, the '211 patent is not based on a theoretical model derived from a well-characterized problem, it does not determine spurt based on parameters determined during both radial and linear flow regimes, and it does not subsume multiple validation and cross-validation means.

Thus, without a reliable means to determine spurt, the estimate of leak off behavior may poorly mimic reality, and therefore, the total amount of fracturing fluid required to optimum fracture design cannot be determined. Additional limitations (other than spurt) in the state-of-the art fracture calibration, to which the present Invention is directed will now be discussed. First, specialized plots (e.g., square root shut-in time) offer multiple possibilities from which to select closure pressure; therefore, these methods require highly subjective interpretation. This shall be demonstrated by example, later in the Application. Second, the fracturing fluid leak-off computation depends upon fracture compliance, yet accurate estimates prior to calibration are often not available.

Therefore, one object of the present Invention is to provide a reliable, empirically based method, that integrates multiple-validation means, to determine fracturing fluid leak-off due to spurt—i.e., fluid lost at the fracture frontier, or tip—and also a highly reliable value for fracture efficiency.

Of equal importance is the second object of the present Invention which is to provide a validation of the fracture length obtained using the conventional approach (dependent on fracture compliance) with a reservoir perspective. The comparison helps validate the fracture compliance and consequently obtain a highly reliable value for leakoff.

SUMMARY OF THE INVENTION

To reiterate: a hydraulic fracture in a hydrocarbon-bearing formation requires that immense amounts of fluid be pumped into the formation; and it requires that small sand-like particles be placed into the fracture before it closes, to keep the fracture open. For reasons explained above, a proper fracture design involves determining the precise amount of fracturing fluid to create the fracture and more importantly, to deliver the proppant particles. Too much fluid (relative to the amount of proppant) and adequate fracture length is not achieved since the propagating fracture front contains too little proppant to deposit in the newly created fracture void. Too little fluid and the fracture cannot be sufficiently propagated. Determining the precise amount of fluid is complicated. During fracturing, the fluid moves forward at the propagating frontier. Much of the fluid (ideally all of it) is eventually lost into the surrounding formation (leak-off from the fracture face). The extent to which this occurs quite naturally determines how much fluid must be used to create the fracture. If fluid leak-off his high, then more fluid must be used. Two fluid-loss mechanisms exist for the fracturing fluid: (1) Carter leak-off (perpendicular to the direction of fracture propagation, and behind the fracture frontier; and (2) spurt (fluid loss at the propagating frontier). The first mechanism is well characterized, the second is not, and in fact is typically guessed at during conventional fracture design. And yet spurt can be the most significant source of fluid loss (it can overwhelm Carter leak-off depending upon the fluid used and the formation type). Therefore, a precise knowledge of spurt is absolutely essential to proper fracture design. The present Invention is directed to a robust, quantitative determination of fracturing leak-off due to spurt.

The present Invention is premised in part on at least three novel insights The first is that since fluid lost into the formation (either through Carter leak-off or spurt) though not directly discernible, it at least evidenced by, or observed from the pressure decline following cessation of fluid injection and well shut-in, then this phenomenon can be compared with the well-characterized problem temperature decay from a semi-infinite surface (into a diffusive medium) which was maintained at constant temperature with a time varying flux of heat which was applied, then is withdrawn. Yet this analogy only holds for linear flow, thus only describes fluid loss due to Carter flow, and therefore, it provides an "ideal" baseline, from which the observed pressure-decline data can be compared, and fluid loss due to spurt, thereby extracted. Thus, the temperature decay behavior might provide suitable proxy for the study of pressure decline, which in turn is indicative of fluid loss. The second novel insight is that fluid loss due to spurt is ideally determined from a combination of parameters—some obtained from pressure-decline data obtained during radial flow, and some obtained from pressure-decline data obtained during linear flow. Third, quite commonly the length of the fracture created during the calibration injection is determined. The present Invention relates the primary parameter of interest, spurt, to fracture length, by a mathematical expression. This determination of spurt. Further a comparison of a reservoir diffusivity dependent fracture length estimate with the conventional fracture length estimate (based on volume balance) helps verify fracture compliance. Each object, aspect, or feature of the present Invention is premised on at least one of these novel insights.

Thus, the primary object of this Invention is a method/process for optimal fracture design, based on determining spurt, or fluid loss at the propagating fracture frontier, wherein spurt is obtained according to a relationship derived through analogy to heat transfer from a semi-infinite surface into a diffusive medium. Fluid loss due to spurt accounts for a substantial portion of the total fluid loss in cases of filtercake formation through the injection of a cross-linked gel in a high permeability formation.

BRIEF DESCRIPTION OF THE FIGURES

FIG. 3 shows a robust region of linear flow between the two vertical lines (at t=18.5–21 minutes).

DETAILED DESCRIPTION OF THE PREFERRED EMBODIMENT

Figure 1:
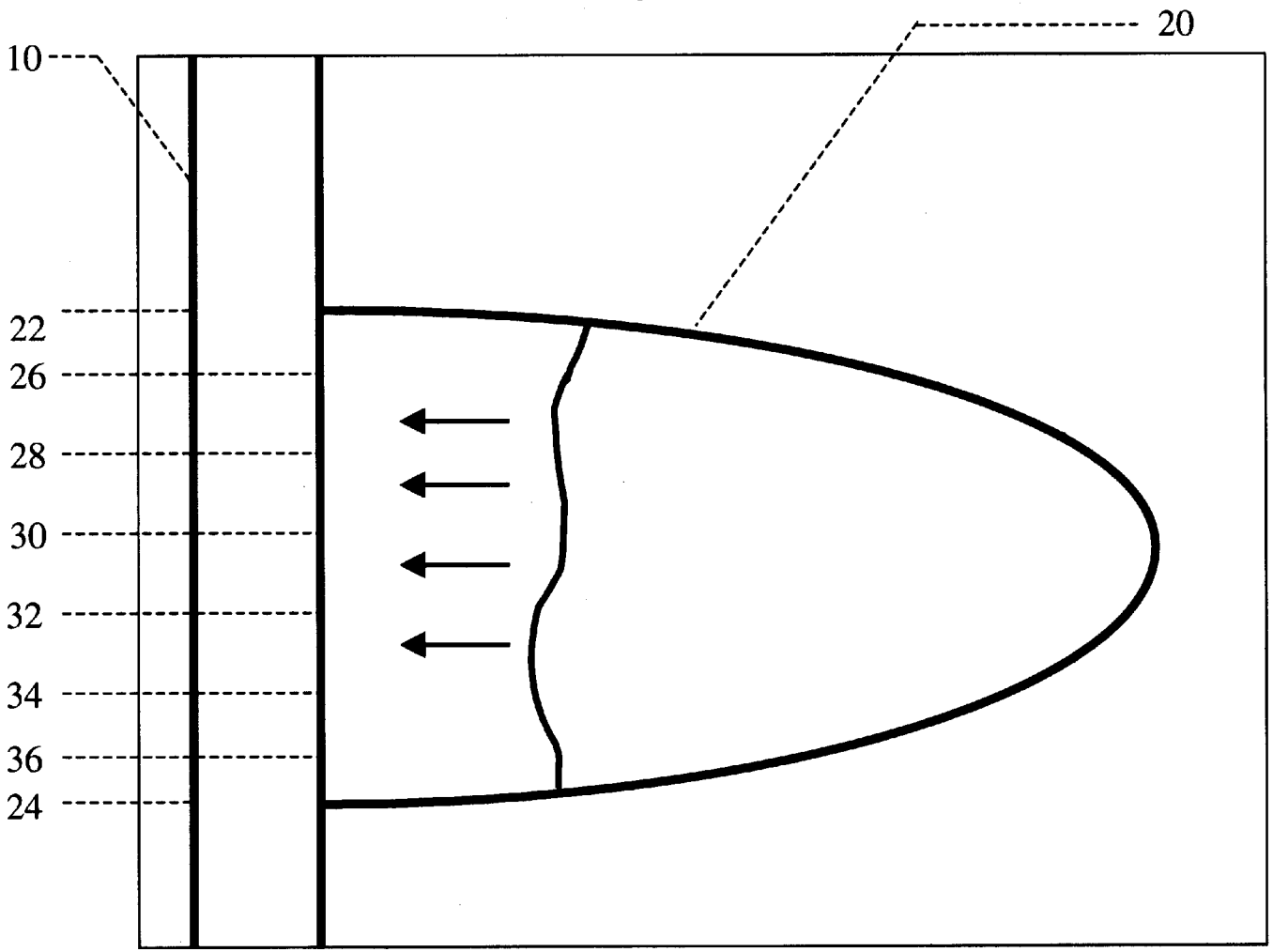
FIG. 1 is a stylized schematic in cross-section depicting salient features of a typical subsurface fracture in relation to the surface and the wellbore.
Figure 2:
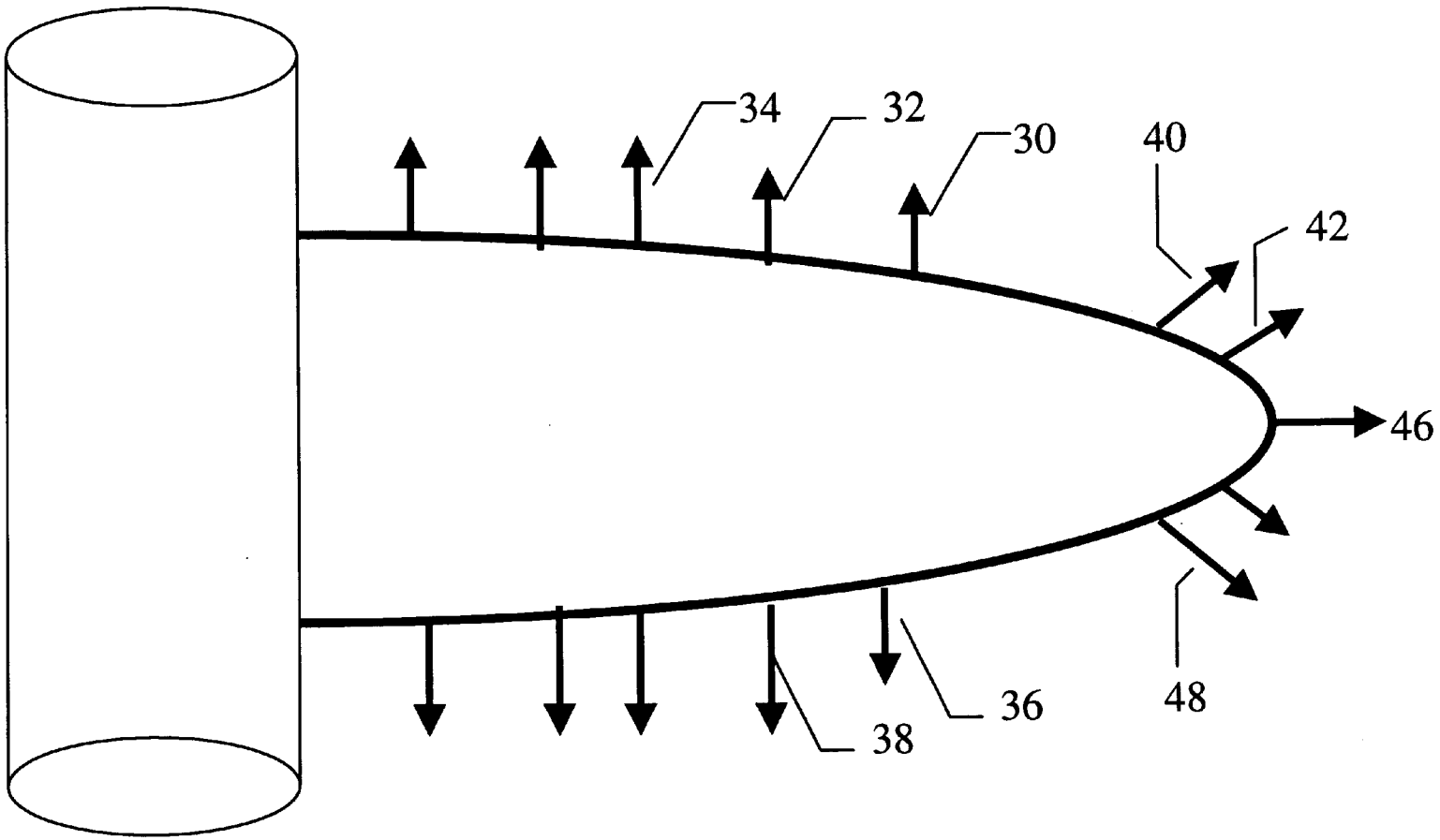
FIG. 2 is a stylized schematic in cross-section of a subsurface fracture, depicting the two primary fracturing fluid-loss mechanisms: Carter leak-off and spurt.

In accordance with the guidelines set forth in M.P.E.P. §608.01(p), the following references are incorporated by reference in their entirety into the present Application. In those instances where a particular portion of the reference is emphasized in this Application, it shall be so indicated:

U.S. Pat. No. 5,305,211, *Method for Determining Fluid-Loss Coefficient and Spurt-Loss,* assigned to Halliburton Company, issued April 1994.

U.S. Pat. No. 5,050,674, *Method for Determining Fracture Closure Pressure and Fracture Volume of a Subsurface Formation,* assigned to Halliburton Company, issued September 1991.

S. N. Gulrajani, et al., *Enhanced Calibration Treatment Analysis for Optimization Fracture Performance: Validation and Field Examples,* SPE 50611 (1998);

K. G. Nolte, et al., *After-Closure Analysis of Fracture Calibration Tests,* SPE 38676 (1997);

K. G. Nolte, et al., *Background for After-Closure Analysis of Fracture Calibration Tests,* SPE 39407 (1997);

Rutqvist, et al., *A Cyclic Hydraulic Jacking Test to Determine the In Situ Stress Normal to a Fracture,* 33 Int. J. Rock Mech. Min. Sci. & Geomech. Abstr., 695 (1996);

Y. Abousleiman, et al., *Formation Permeability Determination by Micro or Mini-Hydraulic Fracturing,* J. Ener. Res. Tech., 104 (1994);

Nolte et al., A Systematic Method of Applying Fracturing Pressure Decline: Part 1, SPE 25845 (1993);

K. G. Nolte, *A General Analysis of Fracturing Pressure Decline With Application to Three Models,* SPE Formation Evaluation, December 1986;

H. S. Carslaw, *Conduction of Heat in Solids,* $2^{nd}$ Ed. Oxford University Press (1959).

In the preferred embodiment of the present Invention the essential steps are stored on a CD-ROM device. In another preferred embodiment, the method/process may be downloadable from a network server, or an internet web page. Moreover, the present Invention can be subsumed within FracCADE, (FracCADE is a Schlumberger mark), which is software developed, used, and owned by Schlumberger to assist in fracturing operations, in particular fracture design.

The present Invention is directed primarily to one having ordinary skill in the art of hydraulically fracturing subsurface hydrocarbon-bearing formations. More precisely, the skilled practitioner, generally within the class of skilled reservoir engineers, to whom this Invention is directed is one with considerable skill in the art of fracture design—i.e., selecting the optimal parameters such as pad fluid type, pad fractions, proppant schedules, and pumping rates, in short the entire fracture design—rather than just execution of the fracturing job. Yet due to large number of steps in some of the preferred embodiment, e.g., some of the steps call for placement of devices in the wellbore, the skilled artisan to which the present Invention is directed also possessed the knowledge of a skilled coiled tubing operator, or wire line operator.

The most elaborate embodiments of the present Invention can be divided heuristically into six distinct parts. In practice, one or more of these phases may overlap, thus the following discussion is organized solely for purposes of more clearly describing the core features of the Invention. The six components are: (1) gathering rock and formation parameters (e.g., porosity); (2) pre-screening to identify candidates for the present suitable to apply the present Invention, which involves selecting reservoirs having a $k/\mu \geqq 20$ millidarcys/centipoise; (3) injecting a first fluid (e.g., water) into the formation under sufficient pressure to induce radial flow, but not enough to fracture the formation, the pressure-decline data from this injection is then obtained, and from this data, the "radial flow" parameters, transmissibility ($kh/\mu$) and reservoir pressure ($p_i$) are determined; (4) injecting a second fluid (e.g., cross-linked guar) into the formation under sufficient pressure to fracture the formation, the pressure-decline data from this injection is then obtained, and from this data the "linear flow" parameters are obtained; (5) determining spurt ($\kappa$), fluid-loss coefficient due to spurt ($S_p$), efficiency ($\eta$), and fracture length ($x_f$); and (6) employing the parameters obtained above to design the fracturing procedure, which consists essentially of determining the optimal pad fractions and the proppant schedules. What follows is a more detailed discussion of these six parts.

The following parameters are relevant in the present Invention:

TABLE 1

| Symbol | Brief Description | Dimensions |
|---|---|---|
| $k$ | permeability | $L^2$ |
| $\mu$ | reservoir fluid viscosity | M/LT |
| $h$ | net pay zone height | L |
| $kh/\mu$ | transmissibility | $TL^4/M$ |
| $m_L$ | linear flow slope | $M/LT^2$ |
| $p_c$ | closure pressure | M/LT2 |
| $t_c$ | closure time (elapsed time from begining of pumping until the fracture closes) | T |
| $t_p$ | pumping time | T |
| $p^*$ | p vs. G-function slope | $M/LT^2$ |
| $G$ | specialized time function | dimensionless |
| $G^*$ | value of specialized time-function indicating pressure decline, at closure | dimensionless |
| $m_{GC}$ | slope of p vs. G at closure | $M/LT^2$ |
| $m_{G'}$ | corrected slope of p vs. G at closure | $M/LT^2$ |
| $m_{3/4}$ | slope at ¾ point of net pressure | $M/LT^2$ |
| $\eta$ | fracturing efficiency | dimensionless |
| $c_t$ | total compressibility | $LT^2/M$ |
| $h_p$ | permeable zone height | L |
| $h_f$ | fracture height | L |
| $\phi$ | porosity | dimensionless |
| $E$ | Young's Modulus | $M/LT^2$ |
| $r_p$ | ratio of permeable to total height | dimensionless |
| $C_R$ | reservoir leakoff coefficient | $L/T^{1/2}$ |
| $C_T$ | total leakoff coefficient | $L/T^{1/2}$ |
| $F_L$ | linear flow time function | dimensionless |
| $F_R$ | radial flow time function | dimensionless |
| $F$ | time function for the changed boundary condition problem in heat transfer | dimensionless |
| $S_P$ | spurt coefficient (volume per unit area) | L |
| $V_i$ | injected volume | $L^3$ |
| $f_c$ | fluid loss length correction factor | dimensionless |
| $f_R$ | fracture recession time fraction | dimensionless |
| $f_K$ | length correction factor for spurt | dimensionless |
| $m_r$ | radial flow slope | $M/LT^2$ |
| $p$ | pressure | $M/LT^2$ |
| $p_i$ | reservoir pressure | $M/LT^2$ |
| $p_{si}$ | shut-in pressure | $M/LT^2$ |
| $t$ | time | T |
| $t_D$ | dimensionless time | dimensionless |
| $t_{knee}$ | knee time | T |
| $x_f$ | fracture length | L |
| $x$ | apparent time correction factor | dimensionless |
| $\gamma$ | reservoir diffusivity | $L^2/T$ |
| $\beta_s$ | ratio of average net pressure in fracture to the wellbore net pressure | dimensionless |
| $\Delta p_s$ | net pressure at shut-in | $M/LT^2$ |
| $q_i$ | injection rate | $L^3/T$ |
| $g_0$ | numerical constant in spurt coefficient equation | dimensionless |
| $f_x$ | apparent length correction factor | dimensionless |
| $f_{pad}$ | pad fraction by volume | dimensionless |
| $\eta_c$ | corrected efficiency | dimensionless |
| $\Delta P_T$ | difference of closure and reservoir pressures | $M/LT^2$ |
| $t^*$ | time corresponding to change of boundary condition in heat transfer problem | T |
| $\kappa$ | spurt correction factor | dimensionless |
| $c_f$ | fracture compliance | $L^2T^2/M$ |
| $c_t$ | total compressibility | $LT^2/M$ |
| $f_{L\kappa}$ | pad fraction contribution due to spurt | dimensionless |
| $f_{v,max}$ | final proppant concentration | dimensionless |
| $f_v$ | instantaneous proppant concentration | dimensionless |
| $\epsilon$ | proppant scheduling exponent | dimensionless |
| $V_f$ | fracture volume | $L^3$ |
| $V_{f,SO}$ | fracture volume at screen-out | $L^3$ |
| $\eta_{SO}$ | efficiency at screen-out | dimensionless |
| $\Delta t_D$ | time fraction past screen-out | dimensionless |

TABLE 1-continued

| Symbol | Brief Description | Dimensions |
|---|---|---|
| $\eta_p$ | efficiency at end of treatment | dimensionless |
| $t_{so}$ | time at screen-out | T |

Reservoir Selection

Two primary indicia determine whether the reservoir is a suitable candidate for the present Invention. First, in the case of very low-permeability reservoirs, observable radial flow will be too difficult to induce within reasonable times after pumping—i.e., ideally the well operator does not wish to wait more than a few hours to begin gathering data; any delay in the predicate fracture design naturally delays the fracturing process itself. For reservoirs having a $k/\mu$ greater than about 20 millidarcies/centipoise, radial flow should occur within reasonable time intervals after pumping has ceased and the well has been shut in. Obviously, this "criterion" is a purely practical—not a theoretical one, and so therefore, the present Invention may well be suitable for reservoirs not meeting this criterion, provided the well operator can wait longer periods of time before fracturing. Second, the present Invention is preferably executed on virgin reservoirs. Reservoirs that have been previously flushed or injected may create pressure transients which will confound the pressure-decline data upon which the present Invention depends.

Rock and Formation Parameters

The following rock and formation parameters—useful in executing the present Invention, though not determined during execution, but rather by some a priori means—are used in a preferred embodiment of the present Invention: E (Young's modulus), $\phi$ (porosity), $h_p$ (permeable zone height), and $c_t$ (total compressibility). Obviously, these parameters can be obtained independently and well in advance of performance of the method/process of the present Invention, since these parameters do not depend upon any fluid-related parameters, and so forth. They are solely rock- and formation-dependent. The methods or techniques used to determine these parameters are well-known in the art to which the present Invention is directed.

The First Injection Event

The goal of the first injection is to induce measurable radial flow and to measure the pressure-decline data after injection. In summary, fluid is injected for a time, then fluid injection ceases, then the well is shut-in, so that any fluid lost is lost through the fracture-formation interface and not into the wellbore. Preferably, the formation should not be fractured during this first injection, otherwise linear flow will likely occur, confounding the analysis (or the well operator will have to wait for linear flow to subside and radial flow to occur). In a preferred embodiment, the fracturing fluid is water, though other types of fracturing fluids will work. Again, since the formation will preferably not be fractured, more expensive, specialized fluids, such as cross-linked guars, are not required.

Prior to the first injection, several prefatory steps may be performed. First, the well must be killed—i.e., the production of hydrocarbon is completely stopped. This is typically done by pumping heavy fluid into the wellbore to create an overbalanced condition. Next, heavy fluid is circulated in the wellbore, followed by circulation of completion fluid. The purpose of this step is to ensure a homogenous column of completion fluid in the wellbore. Next, the perforations—at the location within the formation in which the injection will occur—are cleared to improve communication between the formation and the wellbore.

A next crucial step in the execution of a preferred embodiment is the placement of a device to measure the pressure decline after injection. Three related issues are important here: placing the pressure-monitoring device, recording the pressure data, and retrieving that data. The preferred pressure measurement is "bottomhole pressure," or BHP. To obtain this, the pressure-measuring device gauge should be preferably placed at or near the level of the perforations. In a preferred embodiment, BHP is monitored via a static string (annulus or tubing) placed at or above the location of the perforations. The pressure gauge can also be placed via a coiled tubing unit or a workover rig. In a preferred embodiment, the pressure data is monitored and retrieved in real time. The DataLATCH tool (a Schlumberger product) is capable of providing real time data collection for the present Invention. Aside from these particular embodiments, the pressure gauge can be inserted by any of numerous means known to the skilled artisan, e.g., wireline, slickline, coiled tubing, or a workover rig. In another embodiment, a memory gauge can be placed downhole by, for instance, a slick line, and recovered after each injection. One problem with this technique is that it is unable to yield real time pressures. The pressure-monitoring device used should preferably record that data at a resolution of about 1 psi. At this level of resolution (or lower) the data may still require smoothing, though, as one might expect, the higher the resolution, the better.

Next, the bottomhole pressure is measured prior to the injection—this pressure, which will serve as a baseline against which future measurements are based, must be the true undisturbed pressure, or nearly so. The measurement taken here is the in situ reservoir pressure or $p_i$ (which is different than the in situ rock stress). Once a reliable measurement of $p_i$ is obtained, then the first injection event can begin. The pumping rate should be carefully selected. Ideally, it should be sufficiently low so as to not fracture the formation. However, if the formation is fractured, radial flow may still be obtained if the conditions prescribed in the equations below are met. If sufficient information is available priori, the below equations may also serve as approximate design guidelines.

$$q_i(bpm) \le 4.4\times10^{-6}\left(\frac{kh}{\mu}\right)(p_{si}-p_i);\ \text{for high permeability formations}$$

$$q_i(bpm) \le 6.5\times10^{-6}\left(\frac{kh}{\mu}\right)(p_{si}-p_i);\ \text{for low permeability formations}$$

It should be noted that these equations are preferred approximate conditions to be met, the present Invention can still be executed in some cases where pumping rates vary from these guidelines.

The fluid flow rates are preferably monitored using a flowmeter. The fluid pumped can be selected from a variety of fluids, though since it is not desirable to fracture the subsurface nor deliver proppant, water or another inexpensive low-viscosity fluid is preferred.

After pumping for the prescribed time, at the prescribed rate, a bottomhole shut-in is effected. The goal in this step is to minimize fluid loss through the wellbore after injection has ceased. Obviously, fluid lost to any compartment other than the formation into which the fluid is pumped will confound the pressure-decline data. A bottom-hole shut-in can be effected by a variety of instruments well-known in the art, e.g. IRIS (IRIS is a Schlumberger mark) or a PCT. Both of these are bottomhole ball valves operated by pressure on the drillpipe/tubing annulus.

At this point, the pressure monitoring device has been properly placed, the fluid has been pumped, pumping has ceased, and the well has been shut-in. Now, the pressure is monitored, as a function of time, preferably in real time, and preferably it is monitored near continuously. In the preferred embodiment, the p vs. t data is smoothed by a suitable numerical filter if the pressure gage resolution is too low. Once the pressure data is obtained (or while it is being obtained) the p vs. t data is "normalized." Normalization in this context refers to the series of steps to obtain certain desired reservoir parameters. More particularly, it refers to mathematical means, to obtain a dimensionless time function to represent the particular flow regime (radial or linear). These techniques, shall be discussed in more detail in the Examples, and will become evident upon inspection of the figures referenced in the Examples.

The goal from the first injection is to obtain a value of transmissibility, or $kh/\mu$, which is equal to $(\pi/16) * V_i/m_r t_c$. (closure time, $t_c$, is to be defaulted to the pump time $t_p$ if the formation has not been fractured). Transmissibility will be used, along with parameters obtained from pressure-decline data obtained during linear flow (the second injection event) ultimately to determine fluid loss due to spurt.

Figure 3:
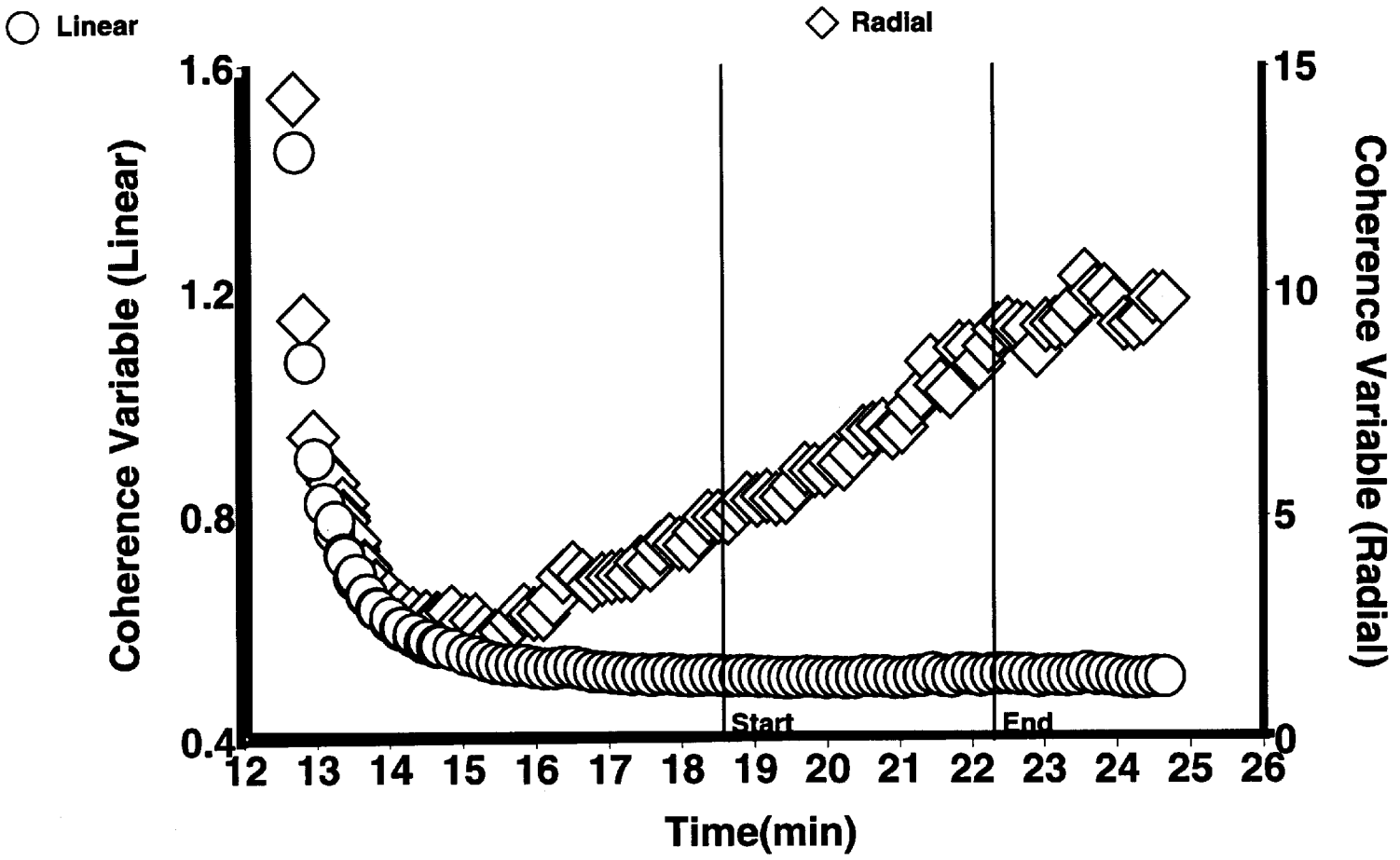
FIG. 3 is a "Flow Regime Identification Plot," or "FLID" plot generated by evaluating the linear-radial intercepts and slopes of each piece-wise segment of the pressure response (p vs. t data recording pressure decline after shut-in); FLID plots are used to, among other things, identify/verify the presence of a particular (linear or radial) flow regime.
Figure 8:
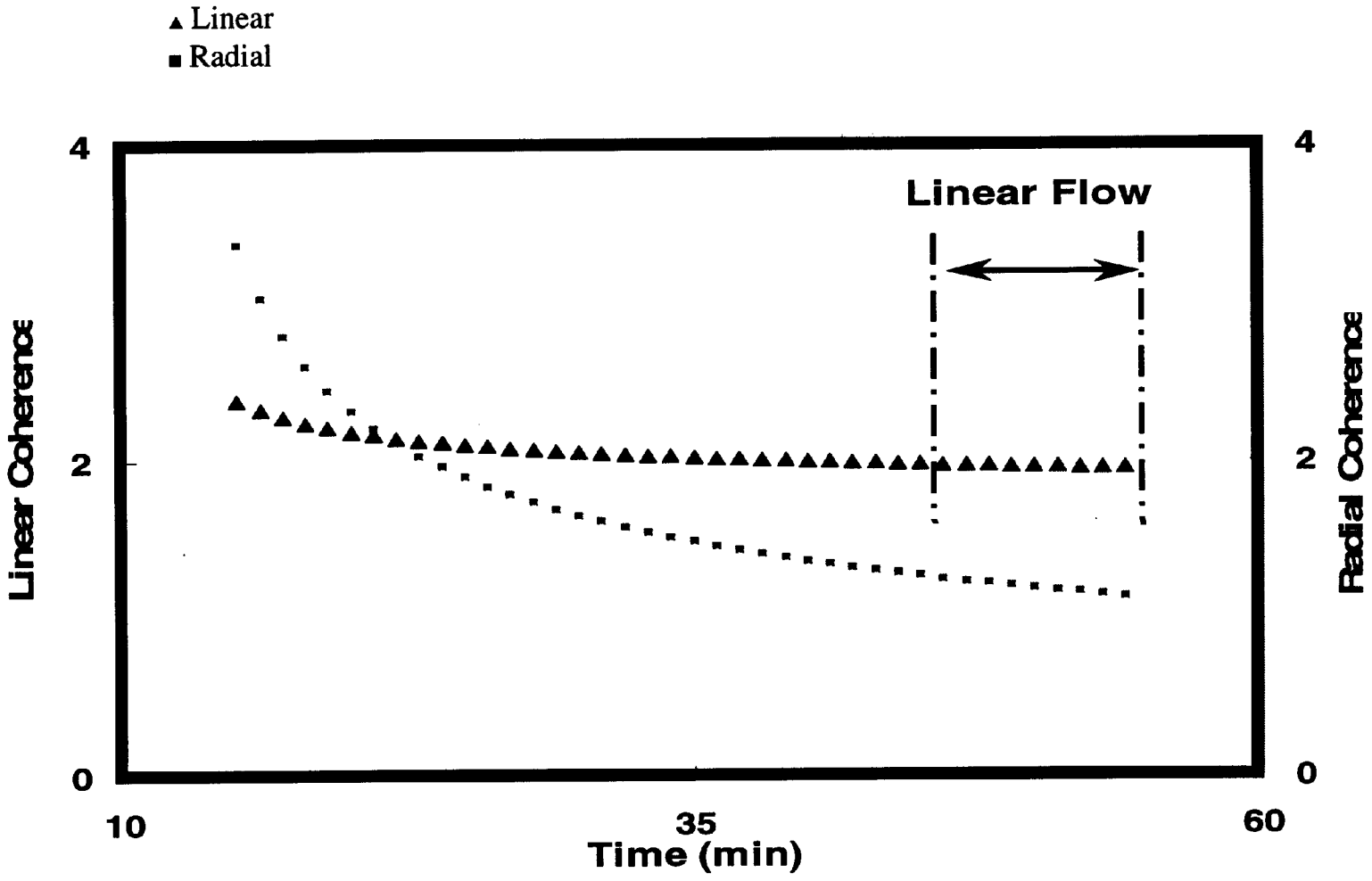
FIG. 8 is another FLID plot, particularly showing a well-defined region of linear flow (between the two broken vertical lines).
Figure 9:
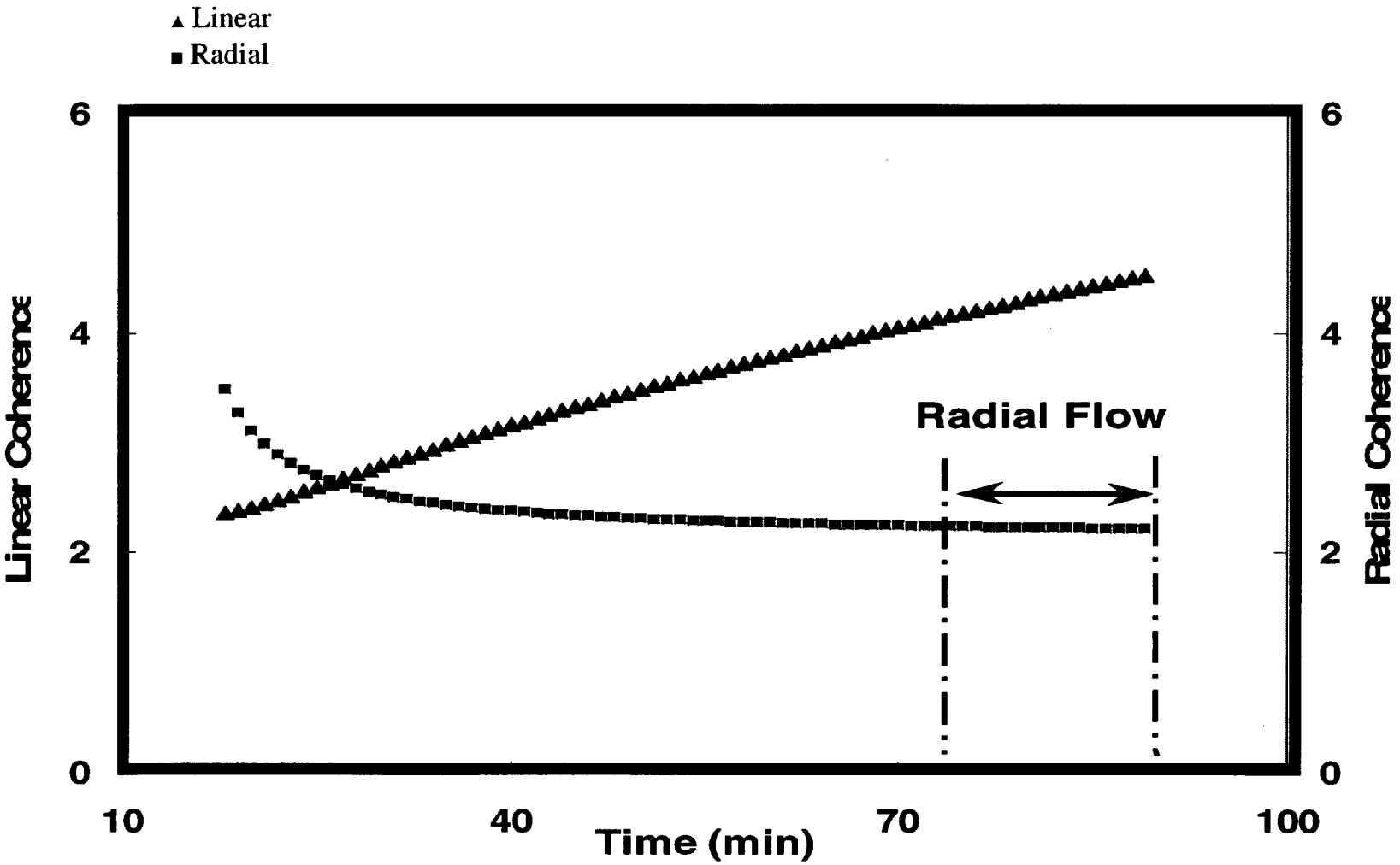
FIG. 9 is a FLID plot, particularly showing a well-defined region of radial flow (between the two broken vertical lines).

After smoothing the data, it is desirable to verify that in fact radial flow has been induced. This can be achieved by a "FLID plot," which presents normalized pressure intercept-slope ratio versus time data, such that the slope (derivative) is with respect to dimensionless time function ("FLID variable"), such plots are shown in FIGS. 3, 8–9. These plots are generated by evaluation of the linear-radial intercepts and slopes of each piece-wise segment of the pressure response using the following two equations, and plotting their respective ratios. A constancy in this ratio for either the linear (FIG. 8) or radial (FIG. 9) case indicates a well-defined linear or radial flow period:

$$p(t)-p_i=m_r F_R(t,t_c)$$

$$p(t)-p_i=m_L F_L(t,t_c)$$

It should be emphasized here, that in cases where the formation is not fractured, as is the case in many tests performed to obtain radial flow information, the closure time $t_c$ is to be defaulted to the pump time $t_p$ in the expression for the radial flow time function as shown ($F_R(t,t_p)$).

Figure 4:
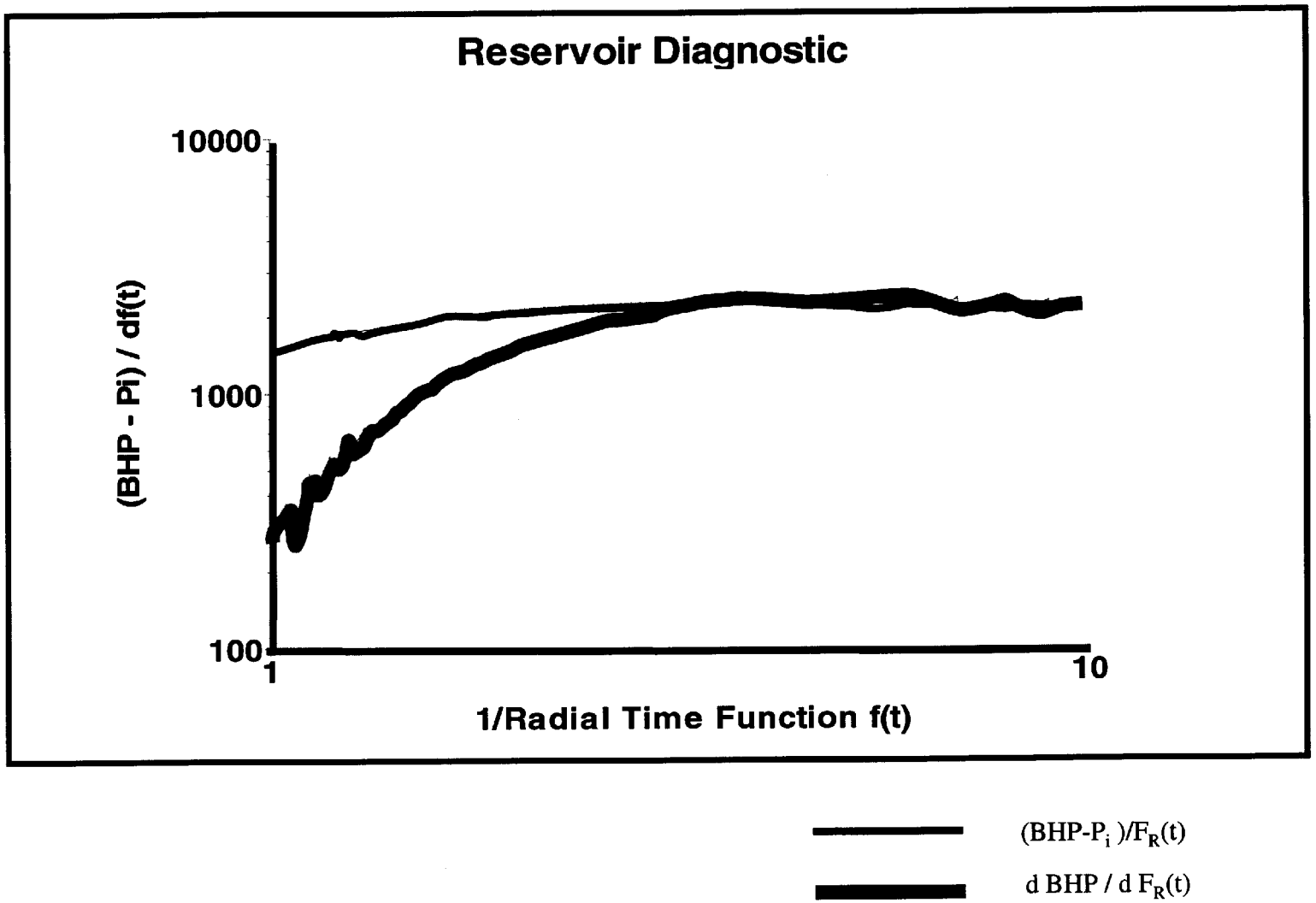
FIG. 4 is a "Reservoir Diagnostic Plot," which is relied upon to verify radial flow and the correct reservoir pressure.

As shown in FIG. 3, (which shows pressure-decline for both injections) the pressure-decline data from the first injection event (shown by the oval symbols) are normalized to obtain a curve having a reasonably smooth portion (shown between the two vertical lines between the left and right axes. One such a range is specified, the average intercept of each point in that range is then calculated. This average is a reasonable estimate of the reservoir pressure, $p_i$. The slope, $m_r$, yields valuable information as well. From this value, in conjunction with the injection volume, and the pump time (closure time to be used if the formation is fractured), transmissibility can be obtained. It is also desirable, though not necessary to verify these parameters. This can be done in a number of ways. Preferably, a "Reservoir Diagnostic Plot" is relied upon to verify radial flow and the correct reservoir pressure. Such a plot is shown in FIG. 4. The radial flow time function is:

$$F_R(t) = \log\left(1 + \frac{\chi t_c}{t - t_c}\right)$$

where $\chi=16/\pi^2$ $t_c$ defaulted to $t_p$ in absence of fracture

Figure 5:
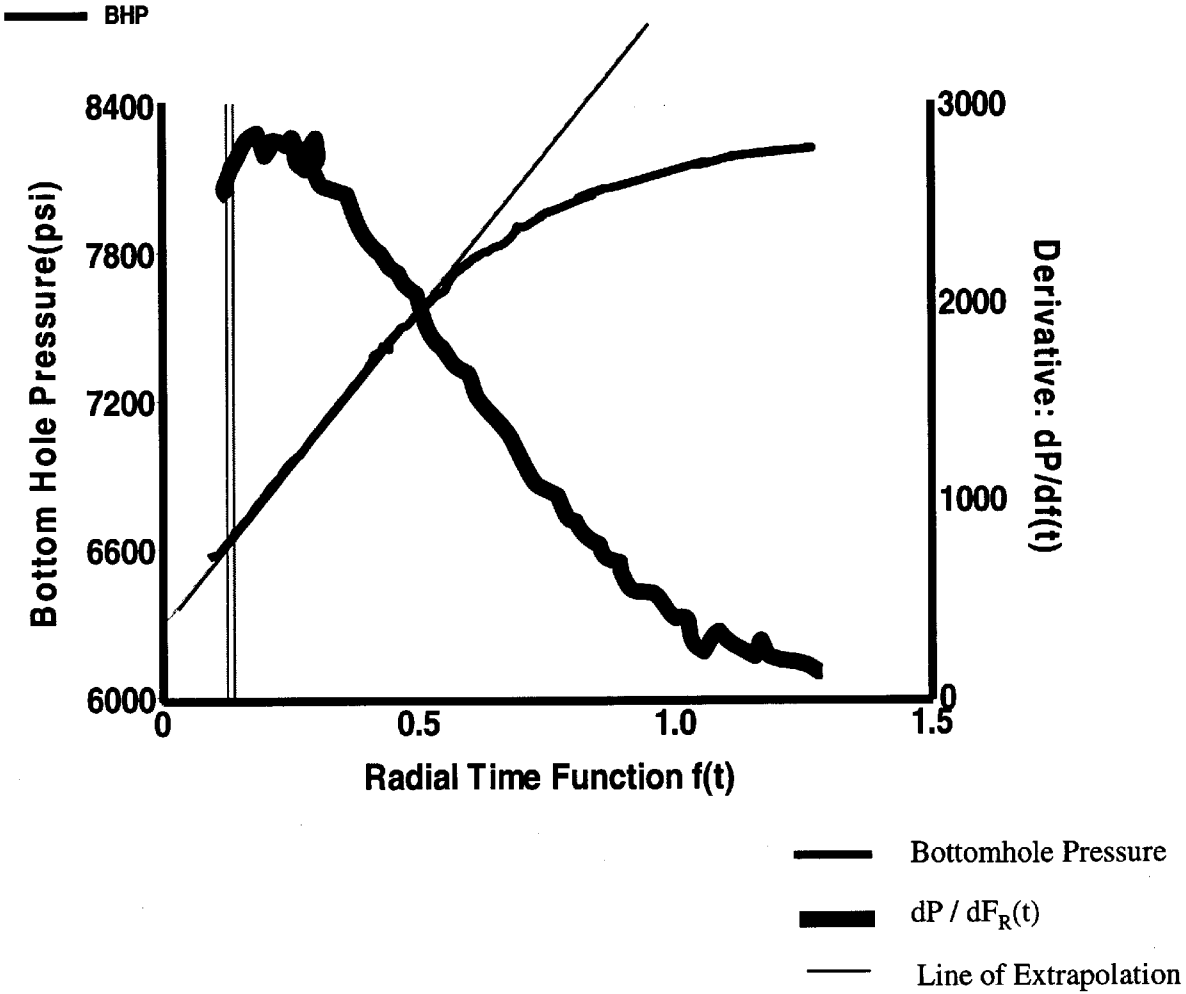
FIG. 5 is another graph plotting normalized p vs. t data, this time to obtain/verify transmissibility and radial flow. A straight-line portion of the curve is selected (shown between the two vertical lines). The presence of a substantial straight-line portion verifies radial flow. The slope of this line yields transmissibility. The intercept gives reservoir pressure.

As evidenced by this Figure, the two curves merge, which indicates that in fact radial flow was achieved, and that the correct reservoir pressure was obtained from the FLID plot. FIG. 5 shows yet another plot of normalized p vs. t data, this time to obtain/verify transmissibility and radial flow. A straight-line portion of the curve is selected (shown between the two vertical lines). The presence of a substantial straight-line portion verifies radial flow. The slope of this line yields transmissibility. The intercept gives reservoir pressure.

The Second Injection Event

Once reliable values of reservoir pressure and transmissibility have been obtained from the first injection event, and sufficient time has elapsed so that the reservoir pressure has returned to normal (pre-injection status), then the second injection event can be initiated. Preferably a different fluid is used for this injection event (compared with the first) since it is now necessary to fracture the formation. In a preferred embodiment, a cross-linked gel is preferably used. This fluid is pumped into the formation at sufficient rates to cause the formation to fracture. At some time later, after fracture, injection ceases, and the well is shut-in to stop further injection of the fluid into the formation. Upon shut-in, the pressure is again monitored, and it is this p vs. t, data, from which the desired parameters are obtained.

Determining a Correction Factor for Spurt ($\kappa$), Spurt-Loss Coefficient ($S_p$), Fluid Efficiency ($\eta$) and Fracture Length ($x_f$)

Figure 6:
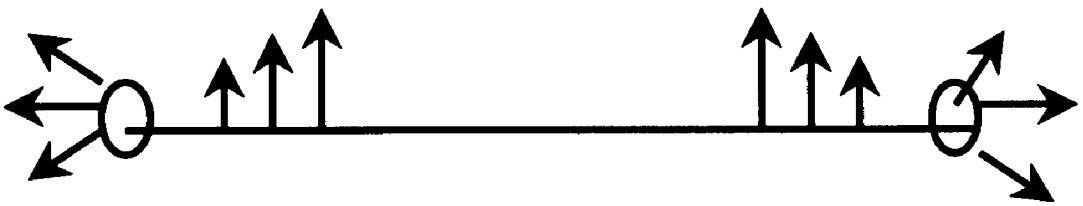
FIG. 6 is a stylized schematic in cross-section, depicting the two fluid-loss mechanisms, Carter leak-off, and spurt.

The purpose of the first injection event was to induce radial flow, and to measure parameters that depend from radial flow. By contrast, the purpose of the second injection event is to obtain linear flow—or flow normal (perpendicular) to the fracture face. The present Invention is based on two novel and distinct insights, both driven by the need to obtain a reliable value for fracturing fluid lost at the frontier of the propagating fracture—i.e., "spurt" loss. More specifically, the question posed was: what time function best represents linear flow? The first insight is that leak-off due to linear flow in the absence of spurt (leak off that occurs normal to the fracture face) shown by the vertical lines in FIG. 6 can be modeled by an analogy with a heat-transfer problem (i.e., temperature decay in a semi-infinite surface). Thus, the linear flow time function of the present Invention was obtained from this analogy. In the discipline of heat transfer, a semi-infinite body whose surface is maintained at a constant temperature relative to its surroundings by means of a flux of energy for a given time, t*, and followed removal of that flux (i.e., insulation of the body's surface), will, under ideal conditions, display a surface temperature decay (as a function of time) given by:

$$F(t, t^*) = \frac{2}{\pi}\sin^{-1}\sqrt{\frac{t^*}{t}}$$

where $t \geqq t^*$

Consider the relevant similarity of this problem to the problem of interest (fracturing fluid loss into a fracture face). The semi-infinite body represents the fracture. Yet this analogy is proper only during linear flow. The fracturing fluid loss is analogous to the heat flux; the temperature decline with time, is analogous to the pressure decline with time. The heat transfer problem also provides two convenient boundary conditions: (1) constant net pressure prior to closure; and (2) uniform fluid loss behavior after closure, both of which are translatable into the problem of interest here.

In addition, if the fracture face propagates at an almost constant net pressure (analogous to the constant temperature boundary condition) then the linear flow problem is virtually equivalent to the heat transfer problem. Hence, if thermal conductivity and diffusivity are substituted for leakoff and reservoir diffusivity, and t* is replaced with closure time, $t_c$, then the following linear flow equation is obtained:

$$\Delta p(t) = C_T\sqrt{\frac{\pi\mu}{k\phi c_t}}\left[\frac{2}{\pi}\sin^{-1}\sqrt{\frac{t_c}{t}}\right]$$

where $t \geqq t_c$;

$$\Delta p_t = p(t) - p_i$$

where p(t) is the pressure at a given time t and $p_i$ is the reservoir pressure Next, the basic linear flow equation, again taken from heat transfer, can be expressed as:

$$p(t) - p_i = m_L * F_L(t)$$

Naturally, this equation is valid is no spurt occurs—i.e, the only flow is normal to the fracture face. Thus, $m_L$ is the slope of a curve on a p(t) vs. $F_L(t)$ plot.

Substituting analogous parameters from the problem of interests, gives $m_L = \Delta p_T * C_T / C_R$, where $\Delta p_T = p_c - p_i$. In this equation, $m_L$ is the slope of linear flow under ideal conditions—i.e., no spurt occurs. The next step is to correlate or to adjust this equation—i.e., obtain a correction factor—by correlating ideal with non-ideal conditions, that is comparing the theoretical curves with those obtained from actual pressure-decline data. Depending on the particular data used, as well as many other factors, the value and form of the correction factor may vary slightly. For instance, different numerical techniques may be used to obtain the correction, which would result in slightly different forms of the correction. Moreover, and most importantly, one may wish to obtain a correction in the form of a dimensionless parameter, or one may instead wish to obtain directly a spurt loss coefficient having actual dimension (e.g., in gal/100 $ft^2$). One may wish to obtain a fluid efficiency (η) directly, which is typically expressed as a percent. This value—which according to the present Invention—embeds fluid loss from both Carter and spurt, and may be used in fracture design. Finally, one may compare a reservoir diffusivity dependent estimate of fracture length to the conventional estimate (dependent on fracture compliance) to validate the fracture compliance and hence obtain an estimate of leak-off coefficient.

Indeed, the value/form of the correction factor is merely an inevitable consequence of the present Invention, which again, is premised on the crucial insight that a pressure decline due to fluid leak off from a subsurface fracture, can be modeled as temperature decay from a semi-infinite body, a particularly well-characterized problem, which then allows one to invoke well-studied equations from which to develop more sophisticated relationships that can be subsequently corrected to incorporate real world phenomenon.

Beginning with the equation shown immediately above, a correction factor was obtained using numerical simulations, which consisted of solving the diffusivity equation and the mass balance relationship, grid-to-grid. The correction factor developed is shown below:

$$1 + (\pi/4)\frac{(\kappa - 1)}{\sqrt{t_c/t_p}}$$

Thus, a proper relationship (yielding a dimensionless parameter) to determine the time dependence of pressure response that accounts for fluid loss due both to Carter leak-off and spurt loss is given by:

$$\kappa = 1 + \frac{4}{\pi}\left[\frac{m_L C_R}{\Delta P_T C_T} - 1\right]\sqrt{t_c/t_p}$$

Alternatively, one may choose to avoid a determination of "spurt" per se (as a dimensionless parameter) altogether, and proceed directly to a spurt correction factor, $S_p$, (having units, for instance in gal/100 $ft^2$) according to the relationship:

$$S_P = (\kappa - 1) g_o C_T \sqrt{t_p}$$

$$g_o \approx \frac{\pi}{2}$$

The second crucial and novel insight disclosed and claimed in this Application is that certain parameters obtained during radial flow (the first injection event) can be used in synergy with those obtained during linear flow (the second injection event) to determine other parameters, most notably spurt. Thus in the equation for spurt, κ, shown immediately above, transmissibility was determined from pressure-decline data obtained during the first injection event, while $m_L$, was obtained from the second-injection event pressure decline data.

In practice, it is preferable to obtain $m_L$ from the slope of a smooth portion of a curve on a plot of p vs. the linear flow time function $F_L(t)$, namely $(2/\pi) * \sin^{-1}((t_c/t)^{1/2})$. This is an iterative method, that is, a value of $m_L$ is obtained, based on a reasonable guess of $t_c$, then it is verified with a more refined value of $t_c$, whereupon $m_L$ is recalculated, and so on.

Figure 7:
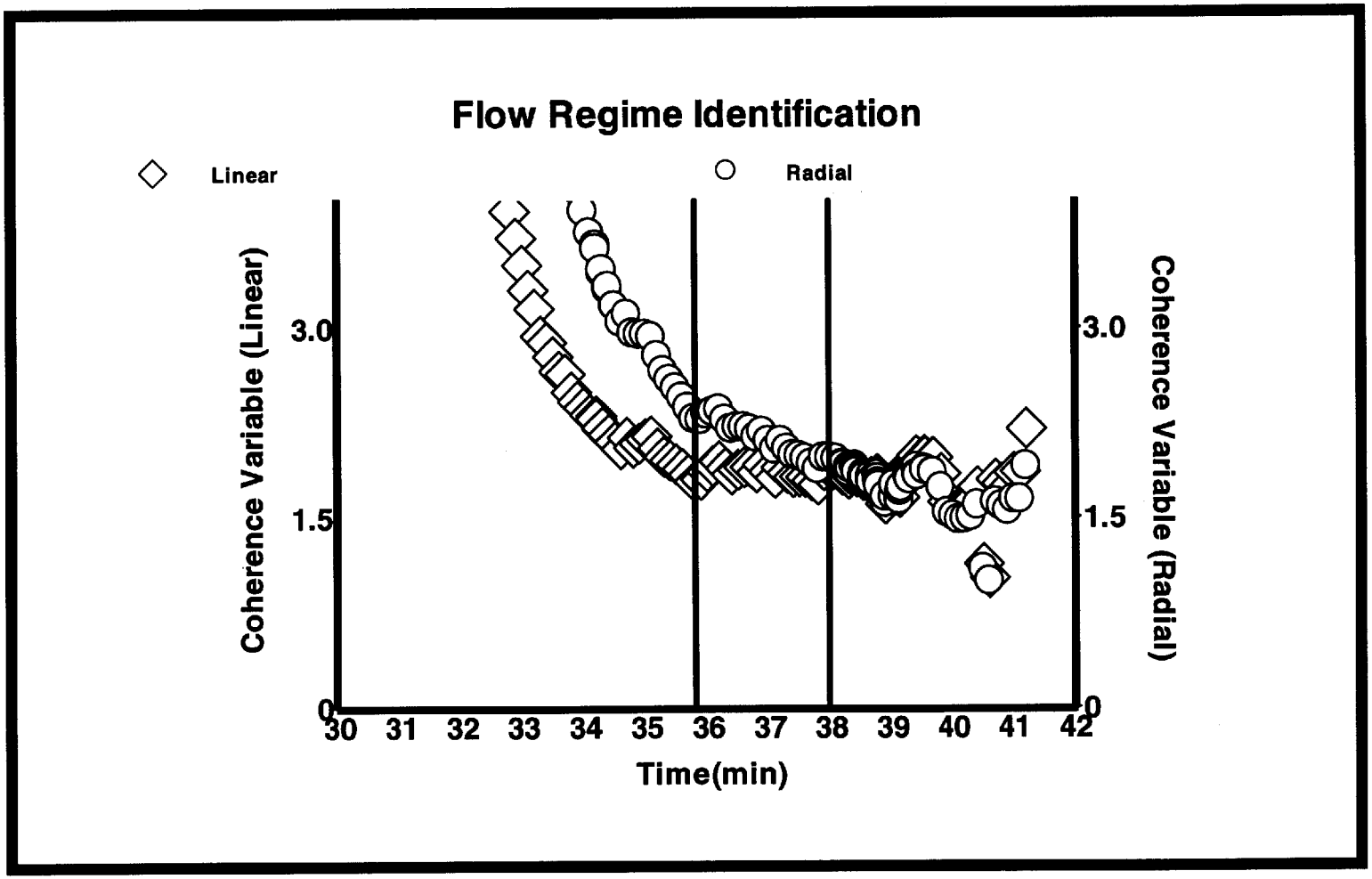
FIG. 7 is a FLID plot.

Additional parameters are obtained from the p vs. t data (normalized to obtain a linear-flow time function). These include most importantly, closure time, $t_c$, or the time (measured from when pumping ceased) at which the fracture closed. This is a notoriously difficult parameter to obtain, particularly since no discernible signature is observable from the time-function plot (nor from the unnormalized data). Indeed, one particularly valuable feature of the present Invention is that it subsumes a method to determine closure time. Put another way, closure time is embedded in the novel expression for spurt. To obtain the remaining parameters of interest, a FLID plot is constructed, shown in FIG. 7, and similar to the one obtained from the first injection event. The goal is to identify a crisply defined linear portion of the linear plot (diamonds). Such a region is shown between the two vertical lines within the y-axes. The linear intercepts for each point within this linear or near-linear region is obtained, in order to verify reservoir pressure. In addition, one should verify that the flow regime from which the data is obtained is in fact a linear flow regime. There are numerous ways to do this; for instance, a plot of $(p - p_i)$ versus $[F_L(t)]^2$ and the corresponding pressure derivative confirms the existence of linear flow.

Returning to the determination of closure time, this parameter is embedded in the time function, therefore it can be determined, for instance, by iterative solution using bisection method with intervals and then comparing the corresponding closure pressure with estimates obtained from independent sources (this shall be illustrated in considerable detail in the Examples that follow). The plots can then be refreshed with the new value of closure time, followed by continuing iteration. The relevant equations to determine closure pressure are given below where $t_1$, $t_2$ are any two times in the linear flow interval:

$$p(t) - p_i = m_L F_L(t, t_c)$$

$$F_L(t, t_c) = \frac{2}{\pi}\sin^{-1}\sqrt{\frac{t_c}{t}}$$

$$\frac{p(t_2) - p_i}{p(t_1) - p_i} = \frac{F_L(t_2, t_c)}{F_L(t_1, t_c)}$$

Once the closure time is known, then the closure pressure is immediately determined since it can be read from a p vs. t plot (i.e., the pressure value that corresponds to that time).

Once closure time is known, linear flow slope, $m_L$, can be determined from the following relationship: $p(t)-p_i=m_L F_L(t,t_c)$. Next, the total leak-off ($C_T$, which represents fluid loss due to both Carter leak-off and spurt) coefficient can be determined according the relationship:

$$C_T = \frac{2p * c_f}{\pi r_p \sqrt{t_p}}$$

$$\text{where } r_p = \frac{h_p}{h_f}$$

The determination of p* shall be discussed in the Examples. Next, the spurt correction factor, κ, can be determined, and from this, the spurt-loss coefficient, $S_p$, can in turn be determined. It is irrelevant whether one chooses to obtain the dimensionless correction factor, before proceeding to determine the coefficient, or whether one chooses to determine the coefficient directly. The spurt correction factor is provided below:

$$\kappa = 1 + \frac{4}{\pi}\left[\frac{m_L C_R}{\Delta P_T C_T} - 1\right]\sqrt{t_c / t_p}$$

Similarly, the spurt correction factor is:

$$S_P = (\kappa - 1) g_o C_T \sqrt{t_p}$$

These relationships demonstrate the tight dependence, indeed synergy, between the parameters obtained during both the first and second injection events. Thus the reservoir fluid-loss coefficient is given as:

$$C_R = \Delta P_T \sqrt{\frac{c_t k \phi}{\pi \mu}}$$

Therefore, the determination of spurt, in whatever form, embeds $k/\mu$, which were obtained from radial flow, and $m_L$ was of course obtained from the linear flow analysis. The prior art methods employ a single injection, which a fracture is created, thus limiting the analysis to determination of linear parameters. The fracture efficiency (as a percent) can be obtained, according to the relationship below:

$$\eta = \frac{G^*}{2\kappa + G^*}$$

An additional aspect of the present Invention is premised upon the novel insight that fracture compliance (a function of Young's modulus and fracture height) can be deduced from the fracture length comparisons obtained from the pressure-decline histories. One might wonder what possible value exists in determining fracture length of a fracture created during calibration treatment—i.e., fracture is simply allowed to close, and the "real" fracture, which determines hydrocarbon production, occurs later. Perhaps for this reason, no one has sought to determine fracture length of the "calibration fracture," yet, as evidenced below, it is a highly useful parameter, and its determination is an integral feature of one aspect of the present Invention. In a preferred aspect of the present Invention, fracture length and efficiency are related, according to the following relationship:

$$x_f = \frac{(1-\eta)V_i}{2\pi(kh_f)C_T\sqrt{t_p}}.$$

This relationship is used to obtain a geometry model-dependent estimate, or where $x_f$ depends on $E/h_f^2$. If a diffusivity-dependent fracture length estimate is desired, i.e. $x_f y^{1/2}$, then a different relationship should be used:

$$x_f = \frac{\sqrt{\pi y t_{knee}}}{f_x}$$

where $t_{knee}$ is given by the relationship:

$$t_{knee} = (2/\pi)^2 t_c (m_r/m_L)^2$$

The term $f_x$ is known as an "apparent-length correction factor," or a correction factor that accounts for spatial and temporal distribution of fluid loss as well as fracture recession. Reservoir diffusivity is given by the relationship: $y=(k/\mu)\phi C_t$, where the denominator is reservoir storage, and the numerator is reservoir mobility.

As evidenced by the two expressions for fracture length shown above, one can readily see the value of the particular aspect of the present Invention (i.e., obtaining an independent value for fracture length). First, it can be used to verify the fracture length obtained by the conventional pressure-decline analysis. Additionally, by substituting the fracture length value into either of the expressions above, efficiency, diffusivity, pay zone modulus, and pay zone height, can be cross-validated. Most importantly, the calibrated fracture compliance obtained through fracture length validation helps determine the total fluid leak-off coefficient accurately.

Employing the Method/Process of the Present Invention for Proper Fracture Design In the next step of the preferred embodiment of the present Invention, the fracturing job is designed. In a typical fracturing operation, detailed in the background section above, fracturing fluid (i.e., "pad fluid") is injected into the formation to create the fracture, followed by injection of proppant with carrier fluid. Thus, in order, for instance, to obtain tip-screen-out, the optimal amount of pad fluid is required. The optimal proppant schedule depends upon the fracture width desired, the amount of pad fluid pumped, which in turn depends upon fluid efficiency, η. Put another way, how much fluid one needs to deliver the proppant particles depends upon how much fluid is going to leak off into the formation, and therefore not available to deliver the proppant as the fracture propagates. As stated earlier, two sources of leak-off, or fluid loss in to the formation, exist: Carter leak-off and spurt. The latter leak-off mechanism was typically guessed at in conventional fracture design. Hence, the applicability of the present Invention to optimal fracture design. Several relationships are developed based on the present Invention to assist the reservoir engineer in designing a proper fracturing job. Two cases shall be considered: (1) tip screen-out is desired; and (2) tip screen-out is not desired. The second cases shall be considered first.

It should be noted here that the efficiency of the fracture treatment may vary from the efficiency of the calibration treatments for a variety of reasons like a larger volume being pumped, effect of prior injections etc. In such situations a suitable correction, scaling of the efficiency obtained from a calibration treatment needs to be performed. Since the efficiency during a fracture treatment is time variant, it should be noted that in the below equations the efficiency term refers to the efficiency at the end of the fracture treatment.

It is useful to disaggregate the pad fractions into that fraction required without spurt, and that required due to spurt:

$$f_{pad}(\eta,\kappa)=f_{pad}(\eta_c,\kappa=1)+f_{L\kappa}$$

where the term "$\eta_c$" is the corrected efficiency at closure in the absence of spurt, and is equal to $$\frac{(\kappa-1)+\eta}{\kappa},$$

and $f_{pad}(\eta_c,\kappa=1)=(1-\eta_c)^2$.

Next,, the pad fraction to account for fluid loss due to spurt, $f_{L\kappa}$, can be determined according to the following relationship:

$$f_{L\kappa}=\frac{(\kappa-1)(1-\eta)}{\kappa}$$

Once the optimal pad fractions have been established, then the proppant schedules can be established. Again, the precise schedule depends upon whether the reservoir engineer desired tip screen out (TSOT) not non-tip screen out (non-TSOT). For non-TSOT, the proppant schedule is based on the volume fraction of proppant, according to the following relationship:

$$f_v(t)=f_{v,\max}\left[\frac{(t/t_p)-f_{pad}}{1-f_{pad}}\right]^{\varepsilon}$$

$$\text{where } \varepsilon=\frac{1-\eta-f_{pad}}{\eta}$$

The factor $f_{v,max}$ is the desired proppant concentration in the propped fracture. In the second case (TSOT desired), the pad fractions are determined from the values of the parameters above, at the time of screen-out. Proppant addition fraction are determined from the efficiency calculated at the end of treatment. Thus, the above equation for volume fraction of proppant also used for TSOT, thus with a different value for efficiency, which is determined from the relationship below (i.e., a scaling equation):

$$\eta_p=\frac{\eta_{so}}{1+\Delta t_D}\,\frac{V_f(\Delta t_D)}{V_{f,so}}$$

$$\text{where } \Delta t_D=\frac{t_p-t_{so}}{t_{so}}$$

The factors $\eta$ is the efficiency at screen-out, $t_{SO}$, is the time to screen-out (generally associated with a dramatic pressure signature), $V_f$ is the fracture volume, $V_{f,SO}$ is the fracture volume at screen-out, and $V_f(\Delta t_D)$ is the fracture volume at a time $t_p$, beyond screen-out.

What follows are several examples in which the present Invention was evaluated under actual conditions. Unless indicated otherwise, the process/method described above was substantially followed in each example.

EXAMPLE 1

A Moderately Permeable Gas Well in South Texas

Figure 10:
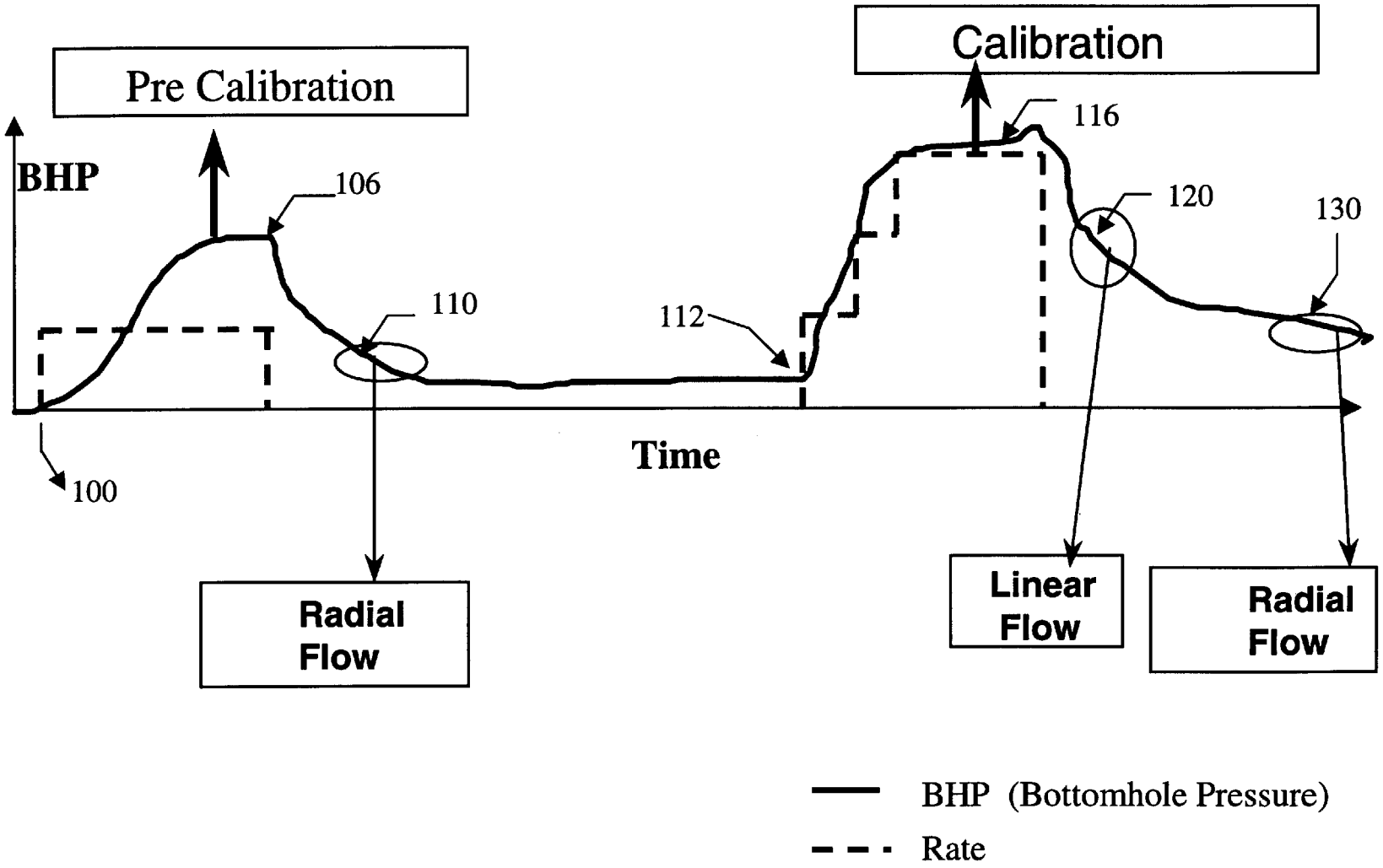
FIG. 10 shows a pumping history, (p vs. t) of the two-injection protocol of the present Invention.

A moderately permeable gas well in a formation in South Texas was selected, having satisfied the reservoir selection criteria discussed above. The steps in this example are roughly the steps recited in the Detailed Description above, with the slight variation that linear flow was not analyzed. Preferred embodiments though, require a two-injection protocol, as shown in FIG. 10. FIG. 10 shows the pumping history (bottomhole pressures versus time) of the two-injection protocol of the present Invention. Pumping is initiated at 100, shut-in occurs at approximately 106, whereupon the pressure-decline data is obtained. The onset of demonstrable radial flow may occur at or near the vicinity of 110. Sometime later, the second injection regimen is initiated beginning at 112; shut-in occurs at about 116, the onset of linear flow at 120, followed by resumption of radial flow at 130. As evidenced from this plot, the present Invention is operable with a single injection (since in the latter injection, both radial and linear flow regimes are identified), though two are preferred.

Figure 11:
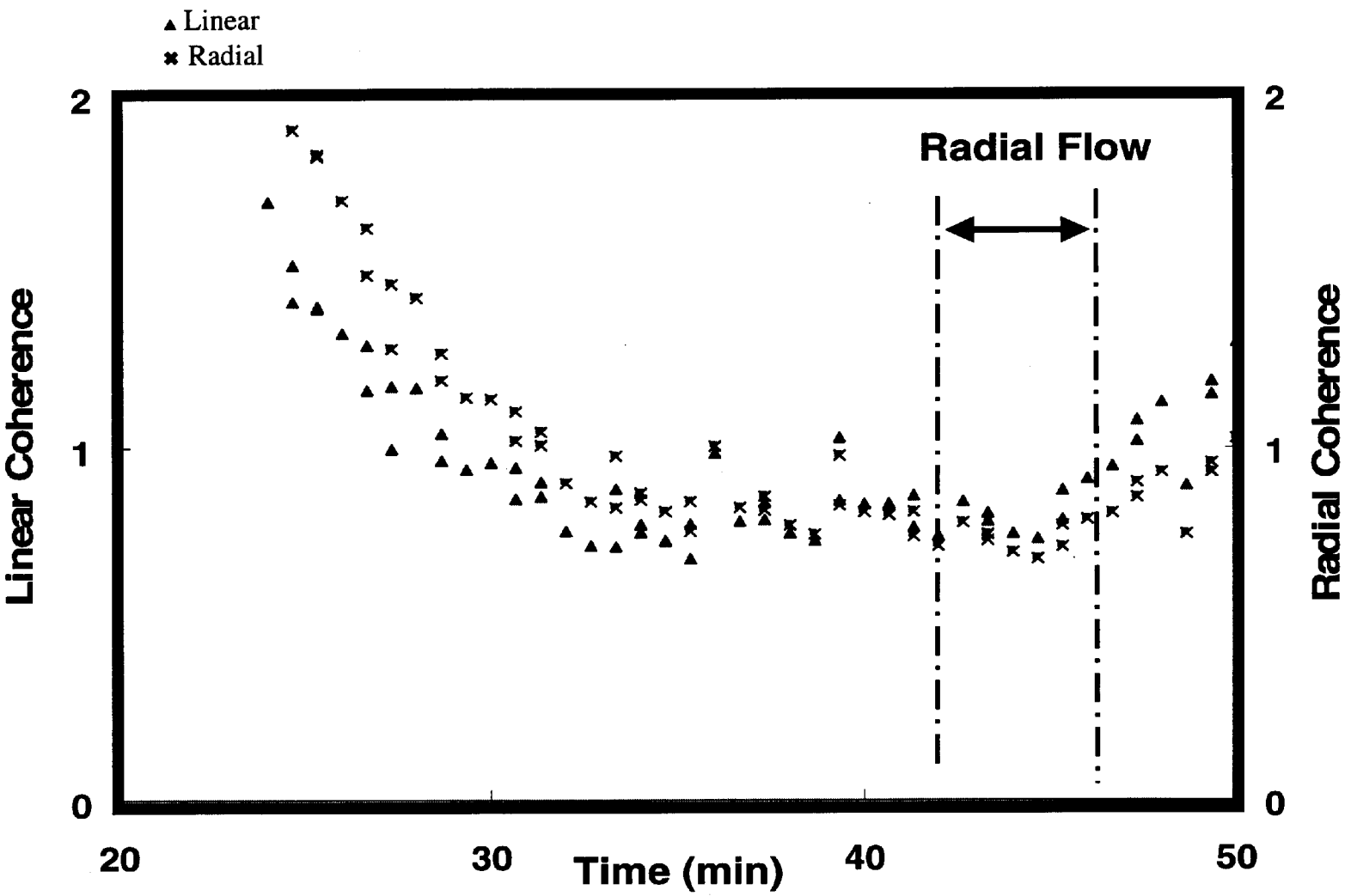
FIG. 11 is another FLID plot showing a region of radial flow.
Figure 12:
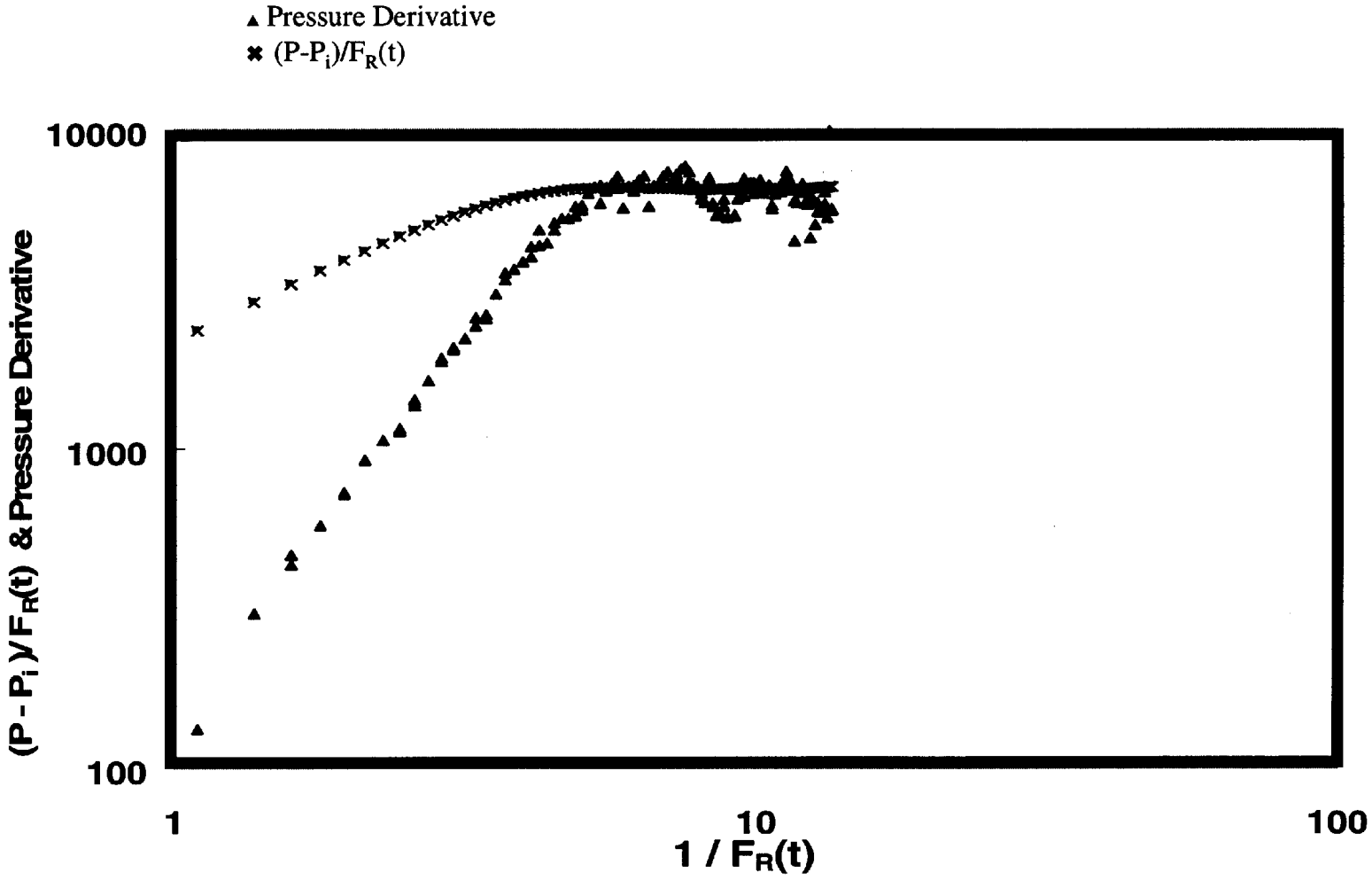
FIG. 12 is a Reservoir Diagnostic Plot, which is relied upon to verify radial flow and the correct reservoir pressure.

The shut-in pressures were smoothed using a filtering technique to ensure smooth pressures and derivatives that were studied to identify post-closure linear and radial flow. The FLID plot obtained from the pressure-decline data is shown in FIG. 11. As evidenced this Figure, and in particular by the region of the radial plot that lies between the two vertical lines, a well-defined period of radial flow, spanning about ten minutes, has occurred. The occurrence of radial flow is further confirmed by the radial flow pressure derivative analysis shown in FIG. 12. From this Figure, one can see that a clean, unambiguous overlap, during the latter stages of pumping, of the two curves: (1) pressure difference-time function ratio; and (2) the corresponding derivatives, provides a highly useful confirmation of radial flow.

Figure 13:
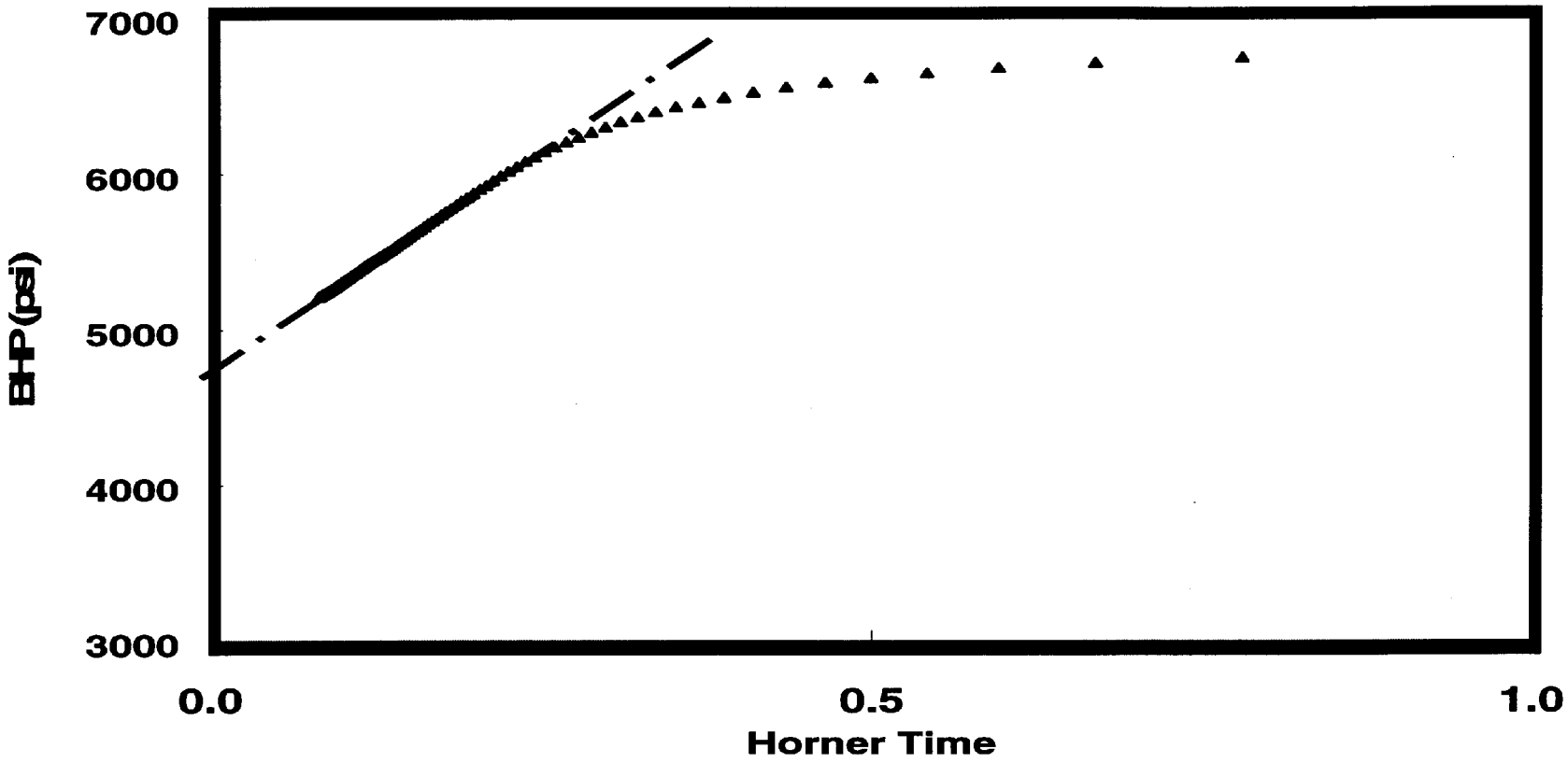
FIG. 13 shows a radial-flow "Horner analysis;" the presence of a straight line and its intercept reveal a reservoir pressure, the slope yields transmissibility.

Next, FIG. 13 provides shows a straight line, over the range of interest, having an intercept of 4675 psi. This is the reservoir pressure, $p_i$. The slope corresponds to the transmissibility, in this instance, as evidenced from FIG. 13, the transmissibility has a value of 369 mD-ft/cp. From a well log-indicated pay zone height of 10 ft, gas viscosity at reservoir conditions of 0.02 cp, and the value of transmissibility obtained immediately above, the formation permeability is calculated, having a value of 0.74 mD. The value for reservoir pressure (4675 psi) is independently corroborated by RFT (Repeat Formation Tester) analysis, which yielded a value of 4664 psi.

EXAMPLE 2

A Moderately Permeable Oil Well in Central America

A moderately permeable gas well in a formation in Central America was selected next, having satisfied the reservoir selection criteria discussed above. Again, the steps in this example are roughly the steps recited in the Detailed Description above, with only slight variation, but in any event the two-injection protocol was performed, as shown in FIG. 10. The purpose of this example is to illustrate that the post-closure linear flow analysis of the present Invention is an invaluable tool to mitigate or completely remove the subjectivity in the closure pressure determination. Indeed, the state-of-the-art techniques for fracture-treatment calibration (which the present Invention is designed to replace), despite extensive formation testing/diagnostic treatment, do not provide an objective method to determine certain parameters crucial to proper fracture design—namely $p_c$, and fluid loss due to spurt.

The two-injection protocol, as described above, and shown in FIG. 10, was modified slightly. In this example, a short-precalibration injection was performed, followed by a step-rate test, and a "minifrac". Minifrac is well-known in the art, and is adequately explained in U.S. Pat. No. 4,749,038. A 40-lb/mgal borate cross-linked fluid was used for all injections. Bottomhole pressures were monitored continuously using a live annulus.

Figure 14:
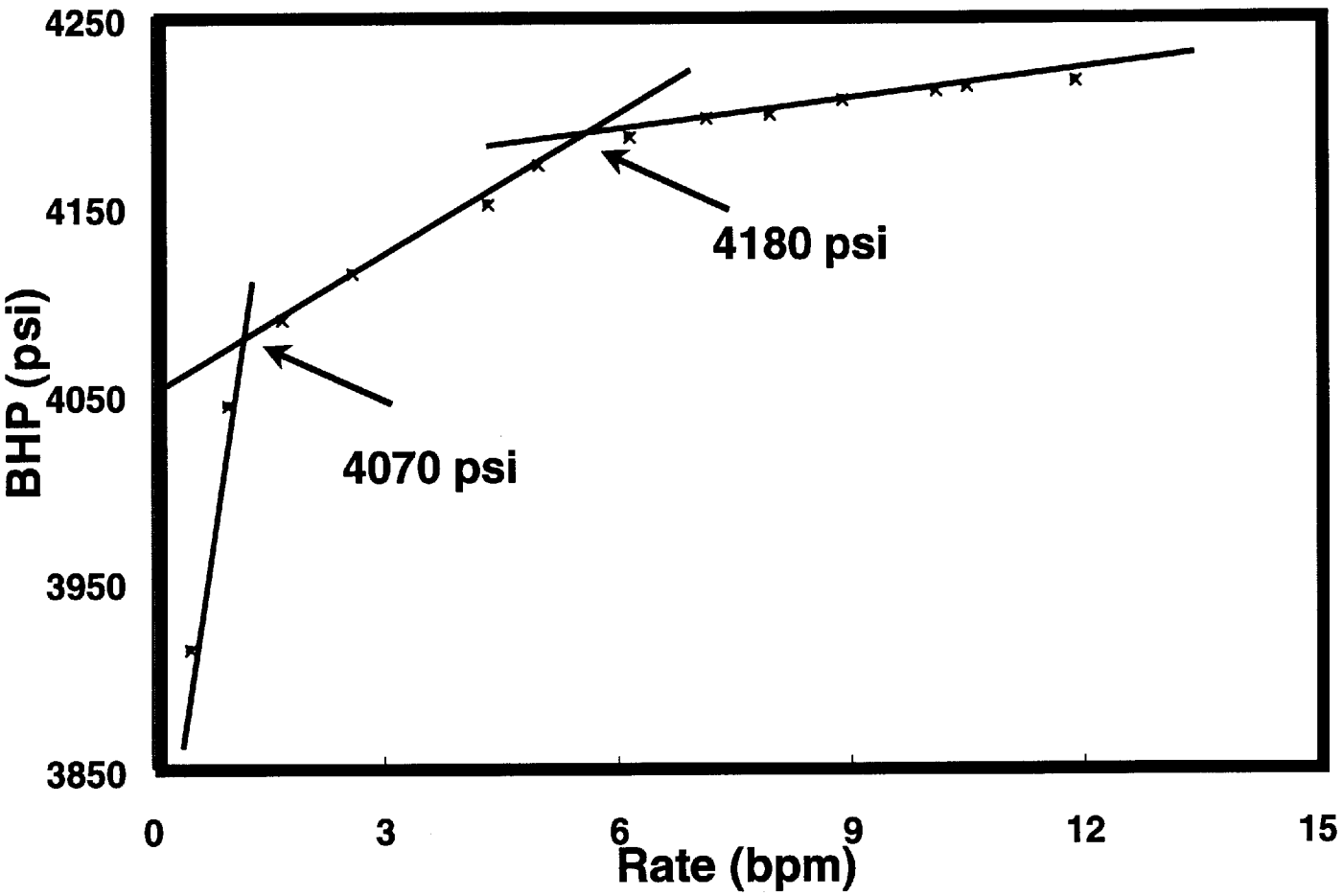
FIG. 14 show a conventional pressure versus rate plot for a step-rate test; this plot shows two discernible inflection points, thus closure pressure cannot be reliably determined from the step-rate test.
Figure 15:
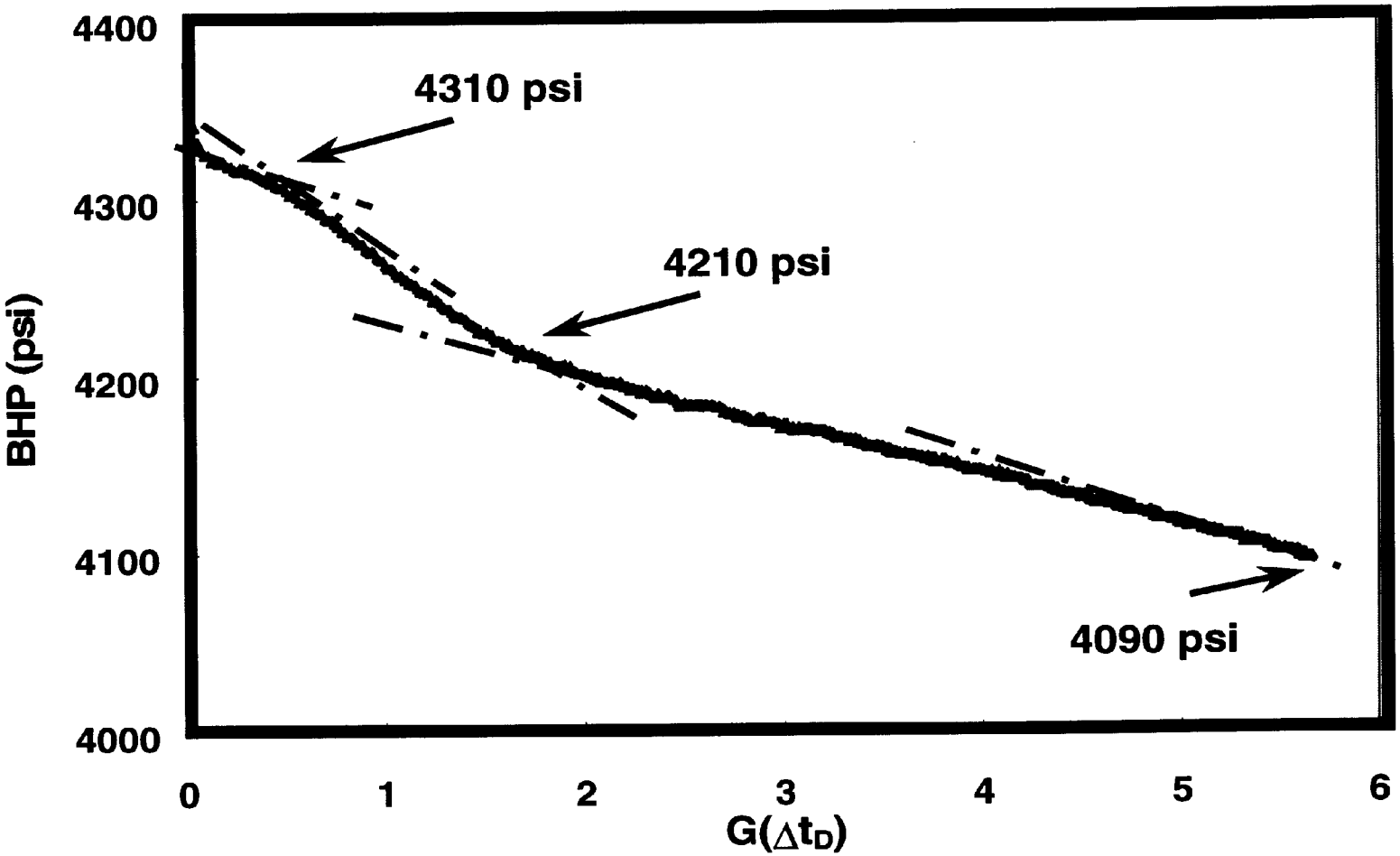
FIG. 15 is a "G-function" plot for shut-in pressures measured during a minifrac.

FIG. 14 shows a conventional pressure versus rate plot, obtained during the step-rate test. As evidenced by FIG. 14, the plot has two breaks: at 4070 psi, and 4180 psi. Therefore, closure pressure cannot be obtained with any degree of objectivity, or certainty, from a conventional step-rate test. FIG. 15 is a G-function plot displaying normalized pressure-decline data obtained after shut-in, during the minifrac analysis. As evidenced from FIG. 15, as in the step-rate test discussed immediately before, closure pressure cannot be determined with any reasonable degree of certainty from the G-function plot. Indeed, FIG. 15 shows more than one plausible candidate for closure pressure, from 4310 to 4090 psi. Therefore, this example (FIGS. 14 and 15) convincingly demonstrate that neither the step-rate test nor the minifrac allow one to objectively determine closure pressure. What follows is an application of the present Invention to further illustrate the deficiency of prior art techniques.

Figure 16:
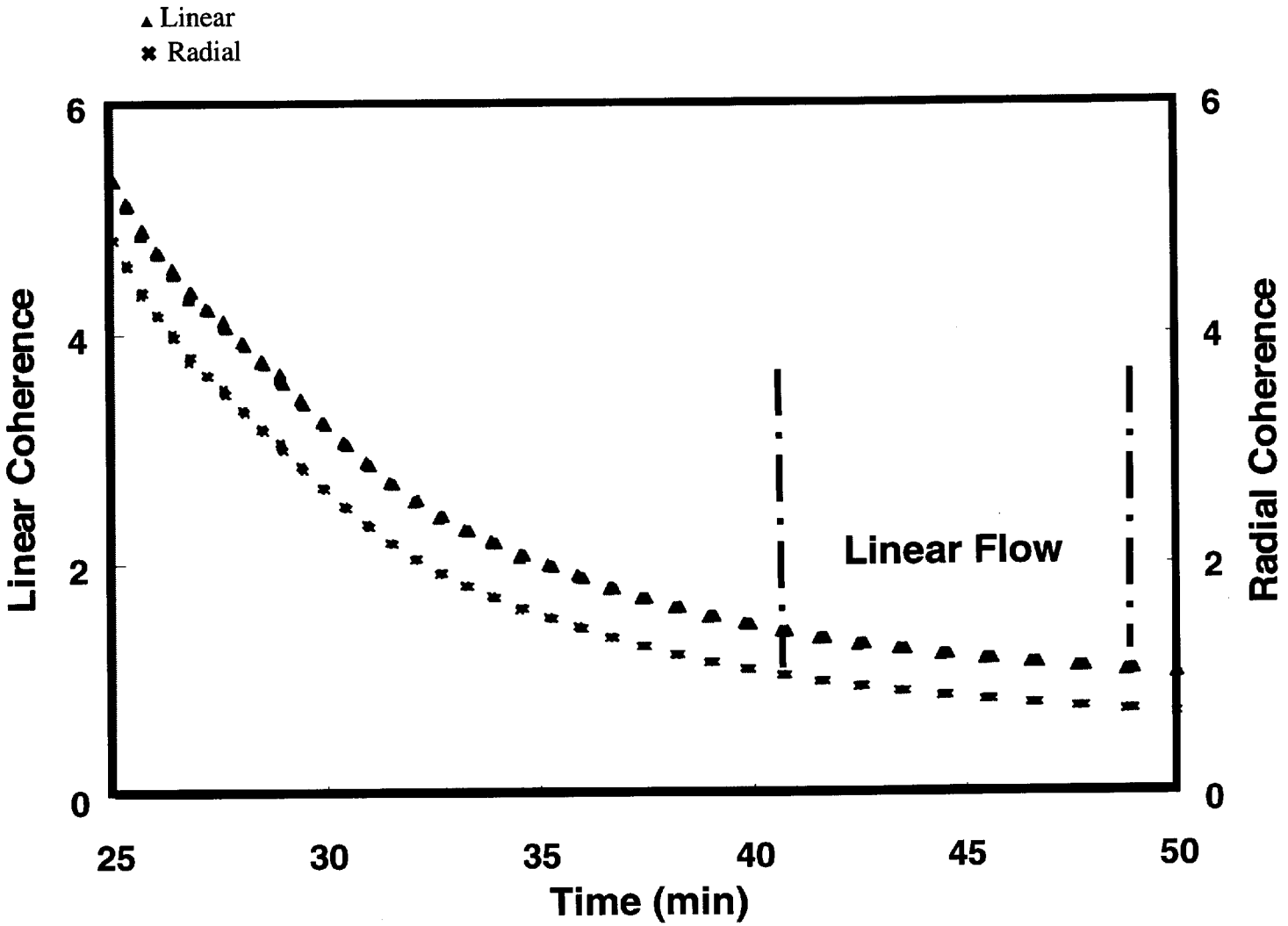
FIG. 16 is another FLID plot.

Following shut-in of the well after the second injection event (to fracture the formation) the occurrence of linear flow is identified once again based on a FLID plot, this time shown in FIG. 16. As evidenced by FIG. 16, an extended period of linear flow (shown between the two vertical broken lines) occurred after shut-in. As before, the next step is to verify the linear flow regime. From FIG. 17, a pressure-derivative analysis, the presence of an extended period of linear flow is verified. Reservoir pressure was initially estimated based on the following equation:

$$p(t)-p_i=m_L F_L(t,t_c)$$

The value obtained from this equation, 2905 psi, agrees substantially with the value obtained from the model, 2870 psi. Closure pressure from the above equation yields a closure time of 19.5 (read directly from a plot p vs. t). This prediction indicates that fracture closure corresponds to the first break in the step-rate test (pressure versus rate plot, FIG. 14). Additionally, fracture closure was not attained at the end of the shut-in phase during the shut-in phase during the minifrac test. An assessment of closure pressure using the equation previously presented yields a closure time of 19.5 minutes, from which one can immediately obtain the corresponding closure pressure, which is 4070 psi. This prediction indicates that fracture closure corresponds to the first break in the pressure-versus-rate plot (FIG. 14), for the step-rate test.

Figure 17:
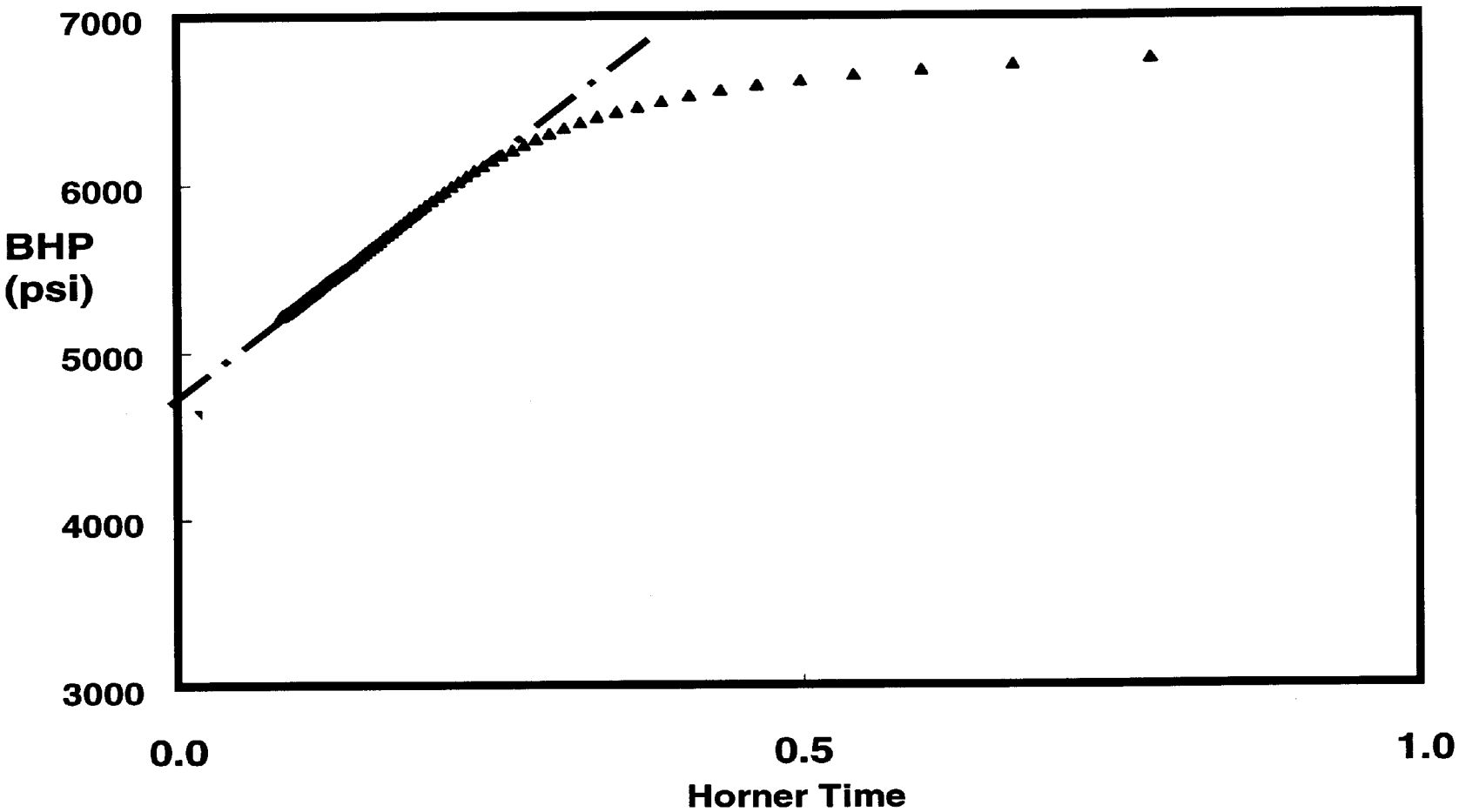
FIG. 17 is a Reservoir Diagnostic Plot, validating linear flow, also showing that linear flow is not obtained immediately following closure.

At first glance, one might argue that FIG. 16 (the FLID plot) indicates the presence of radial flow. In fact, the possibility of radial flow is eliminated by observing the correspondingly indicated intercept of 3650 psi (from the linear flow counterpart to the equation shown immediately above). Such a high value of reservoir pressure is not anticipated for this formation. Therefore, one may conclude that this does not correspond to a distinct radial flow signature. FIG. 17 illustrates that linear flow did not instantaneously occur following closure. This could be attributed to non-ideal conditions, in turn perhaps attributable to heat-up of the displacement gel fluid during the shut-in period.

Finally, the validity of the parameters obtained based on pressure-decline data obtained during the second-injection event, were validated by comparing the fracture length predicted by the post-closure analysis (of the present Invention) with the conventional method (pressure-decline analysis). Using the permeability inferred by the production analysis (2 mD) the reservoir fluid viscosity (0.019 cp) the fracture height obtained by a radioactive tracer survey (31 ft) and the cumulative volume injected (72 bbl), the radial flow slope is estimated from the following equation:

$$F_R(t) = \log\left(1 + \frac{\chi\, t_c}{t - t_c}\right)$$

where $\chi=16/\pi^2$ as 1176 psi. The equation:

$$x_f = (1/f_x)\sqrt{\pi\gamma t_{knee}}$$

$$\text{where } f_x = \frac{f_c + f_k}{1 + f_k}$$

then gives a fracture length of 103 ft. The "¾ rule" is used to determine the fluid-loss characteristics. This rule, as it is applied in the present Invention, shall be explained below.

The conventional pressure decline analysis used to estimate fluid leak-off coefficient and treatment efficiency assumes a wall-building control fluid loss behavior. In addition, the fluid-behavior is assumed to be independent of pressure; and the fracture length is assumed to remain constant and equal to its value at the end of injection, throughout the shut-in period. Corrections to account for these assumptions, presented in Nolte et al., A Systematic Method of Applying Fracturing Pressure Decline: Part 1, SPE 25845 (1993), are referred to as the ¾ rule for fluid leak-off estimation. According to the ¾ rule, fluid loss should be based on the rate of pressure decline at a point where the wellbore pressure attains ¾ of the between the pressure at shut-in and the pressure at fracture closure. This decline rate provides an optimum for considering the effects of pressure dependent fluid loss, fracture height growth, and fracture length changes during shut-in. In addition, the effects on the pressure response resulting from pressure dependent leak-off are considered using additional calibration factors that appropriately modify the slope of the G-function during pressure decline, to account for such time-dependence fluid-loss behavior. The semi-analytical ¾ rule suggests that the rate of pressure decline on a G-plot be estimated at the ¾ point, called $m_{3/4}$, to account for fracture length changes during shut-in. In addition, the slope at closure, called $m_{GC}$, is modified to account for fracture height recession during shut-in. This corrected slope, referred to as $m_{G'}$ is then compared with $m_{3/4}$, and the maximum of these two values is referred to as p*, or $p^*=\max(m_{3/4}, m_{G'})$. Next, p* can then be related to the fluid leak-off coefficient as:

$$C_T = \frac{2p * c_f}{\pi r_p \sqrt{t_p}}$$

where $r_p$ is the ratio of the fluid-loss height to the total height and $t_p$ is pump time. The total fluid leakoff coefficient depends on fracture compliance and for the commonly encountered case of a fracture with a very large aspect ratio ($x_f/h_f$), $c_f \cong h_f/E'$, where E' is the plane strain Young's modulus.

The corrected value of G at closure, a.k.a. G*, is then obtained using the following relationship: $G^* = (\Delta p_s)/p^*$. Here, $\Delta p_s$ is the net pressure at shut-in, and p* is determined from $p^* = \max(m_{3/4}, m_{G'})$. Next, the treatment efficiency is obtained according to:

$$\eta = \frac{G^*}{2\kappa + G^*}$$

Again, κ is the spurt correction (unitless) and is calculated from the following equation:

$$\kappa = 1 + \frac{S_p}{g_o C_T \sqrt{t_p}}$$

The parameter $S_p$ is the spurt coefficient. Lastly, the fracture length is determined using a volume-balance equation:

$$x_f = \frac{(1-\eta)V_i}{2\pi\kappa h_f C_T \sqrt{t_p}}$$

where h is the permeable fracture height, $V_i$ is the total volume of fluid injected, and η is the fluid efficiency.

Returning to the example, the fluid leak-off coefficient is thus determined as 1.8×10−3 ft/min½. From this, a treatment efficiency of 21%. And the fracture length is determined to be 96 ft, which substantially agrees with the value obtained above (103 ft).

EXAMPLE 3

A Highly Permeable Oil Well in South America

Next, an unconsolidated, very highly permeable oil well in a formation in South America was selected, having satisfied the reservoir selection criteria discussed above. In addition, the production interval is relatively homogeneous and massive. Open-hole logs indicate the presence of well-defined shale barriers that should contain the fracture within the producing zone. Again, the steps in this example are roughly the steps recited in the Detailed Description above, with only slight variation, but in any event the two-injection protocol was performed, as shown in FIG. 10. The purpose of this example is to illustrate the post-closure linear flow analysis.

Figure 18:
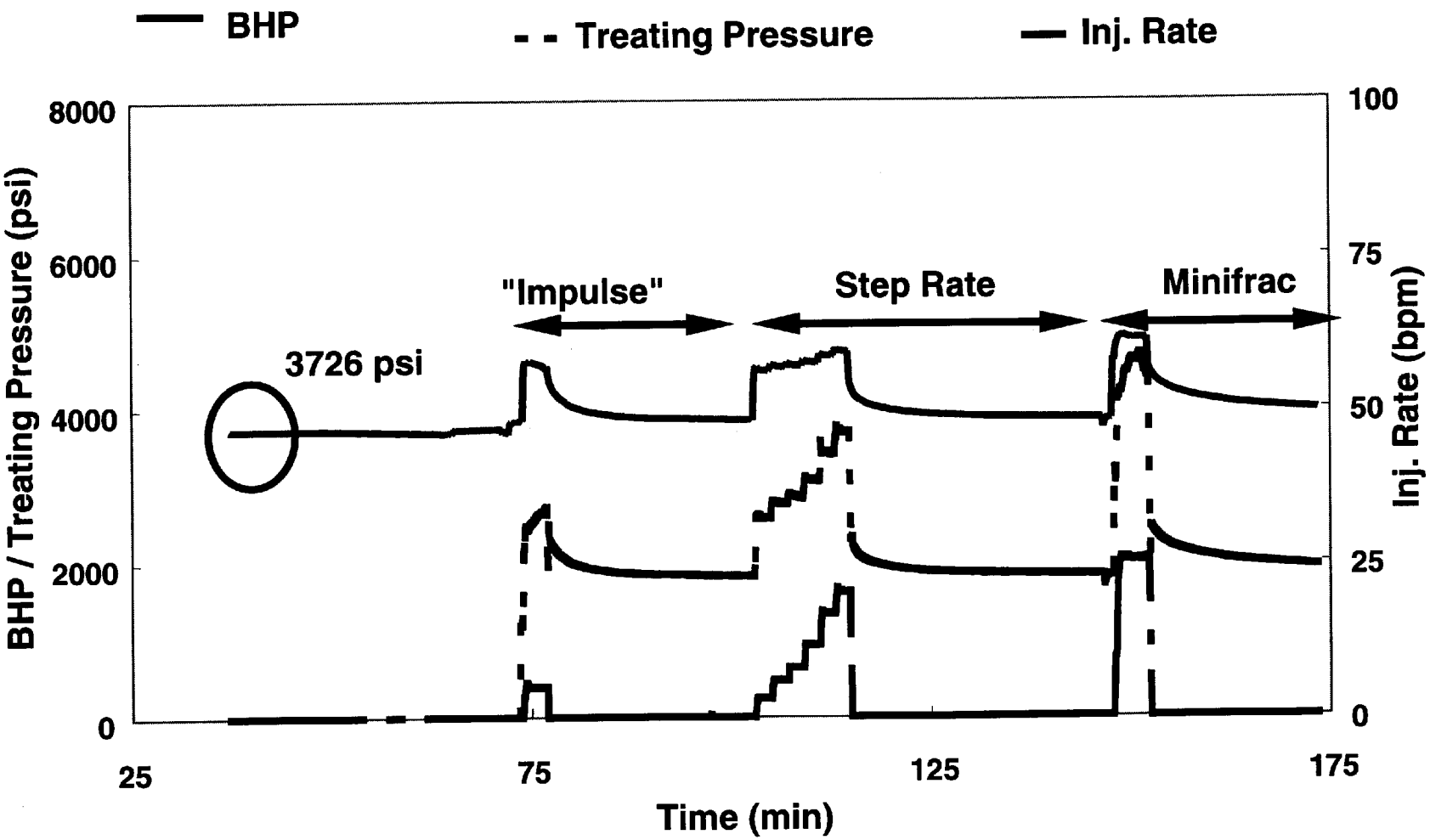
FIG. 18 shows the injection or treatment parameters measure during the testing sequence, used in Example 3.

A short "impulse" injection proceeded the step rate test and the minifrac. A 30-lbm/mgal delayed borate cross-linked fluid was used throughout the calibration tests and the proppant injection. A direct measurement of bottomhole pressures was available using retrievable downhole presure gages. The treatment parameters measured during the entire testing sequence are shown in FIG. 18. This Figure also shows the stabilized pressure on the bottomhole gauge to be 3726 psi. This stabilized pressure measurement provides an independent and objective assessment of the reservoir pressure and will be referred to during the analysis to reduce uncertainty during the flow regime identification process.

Figure 19:
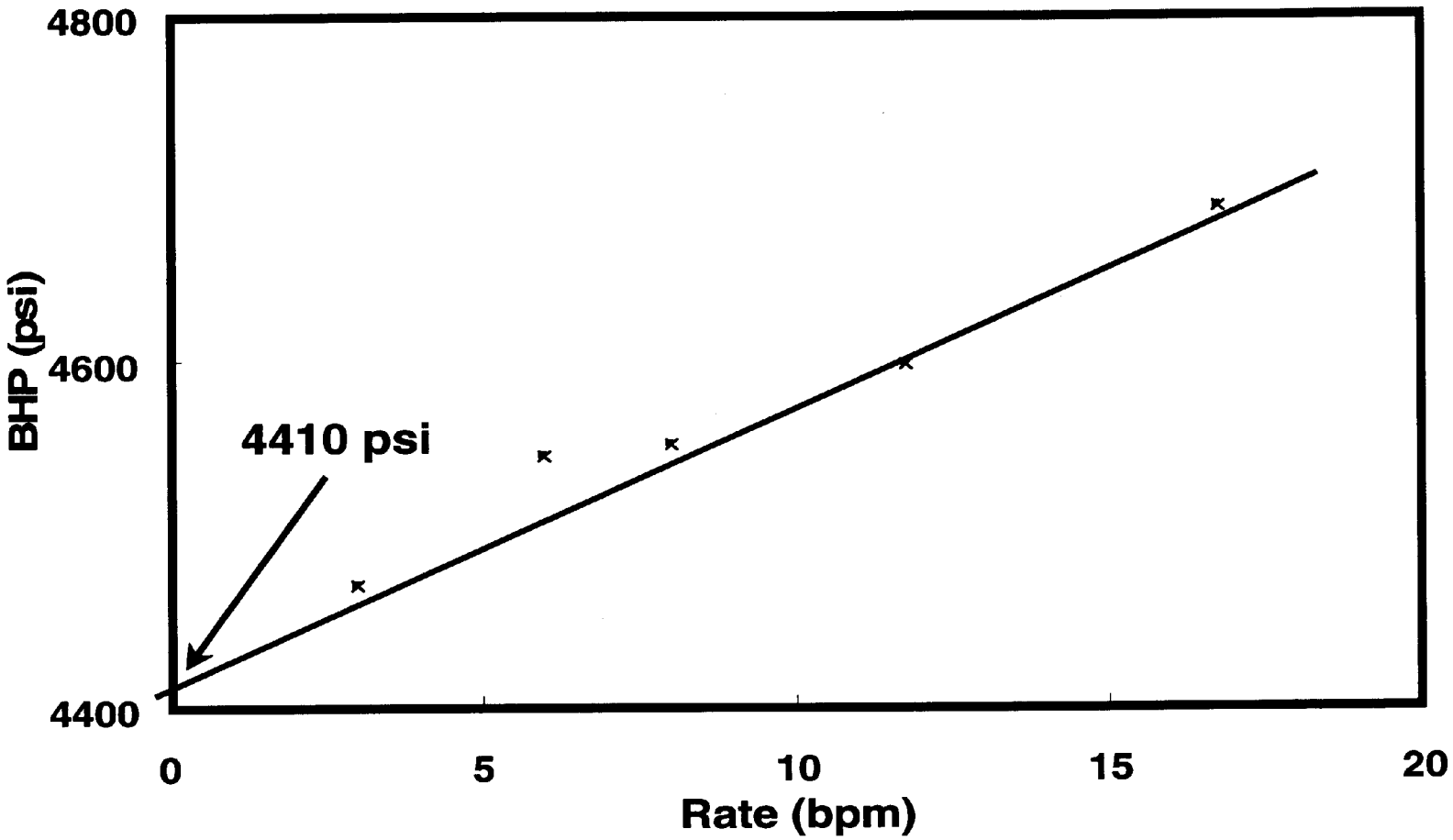
FIG. 19 is a pressure-versus rate plot for a step-rate test, showing the lack of a clearly discernible break.
Figure 20:
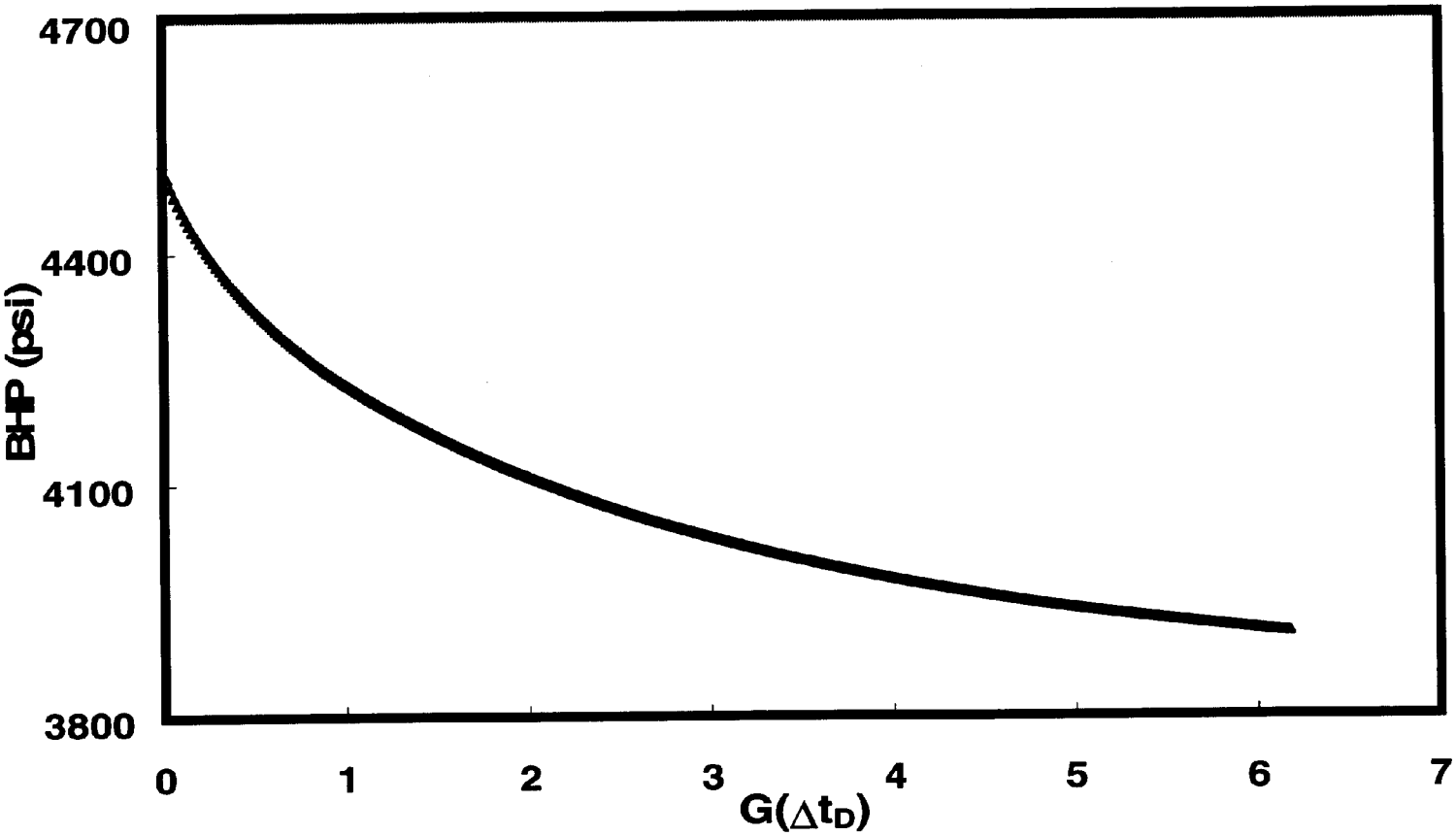
FIG. 20 is a G-function plot, showing a smooth variation throughout shut-in (therefore not able to discern closure pressure).

As evidenced by FIG. 19, no clearly defined inflection is observable. On the other hand, at least one group of investigators have determined that for the Step Rate plot the y-intercept of the line representing fracture extension is a very good approximation for closure pressure. (See, Rutqvist, et al., *A Cyclic Hydraulic Jacking Test to Determine the In Situ Stress Normal to a Fracture,* 33 Int. J. Rock Mech. Min. Sci. & Geomech. Abstr., 695 (1996).) FIG. 19 shows this intercept, and therefore a good approximation for closure pressure, as 4410 psi. The G-function plot is shown in FIG. 20. This plot shows a smooth variation—i.e, no discernible inflection—throughout shut-in and so, once again, is also unable to provide an objective indication of closure pressure.

Figure 21:
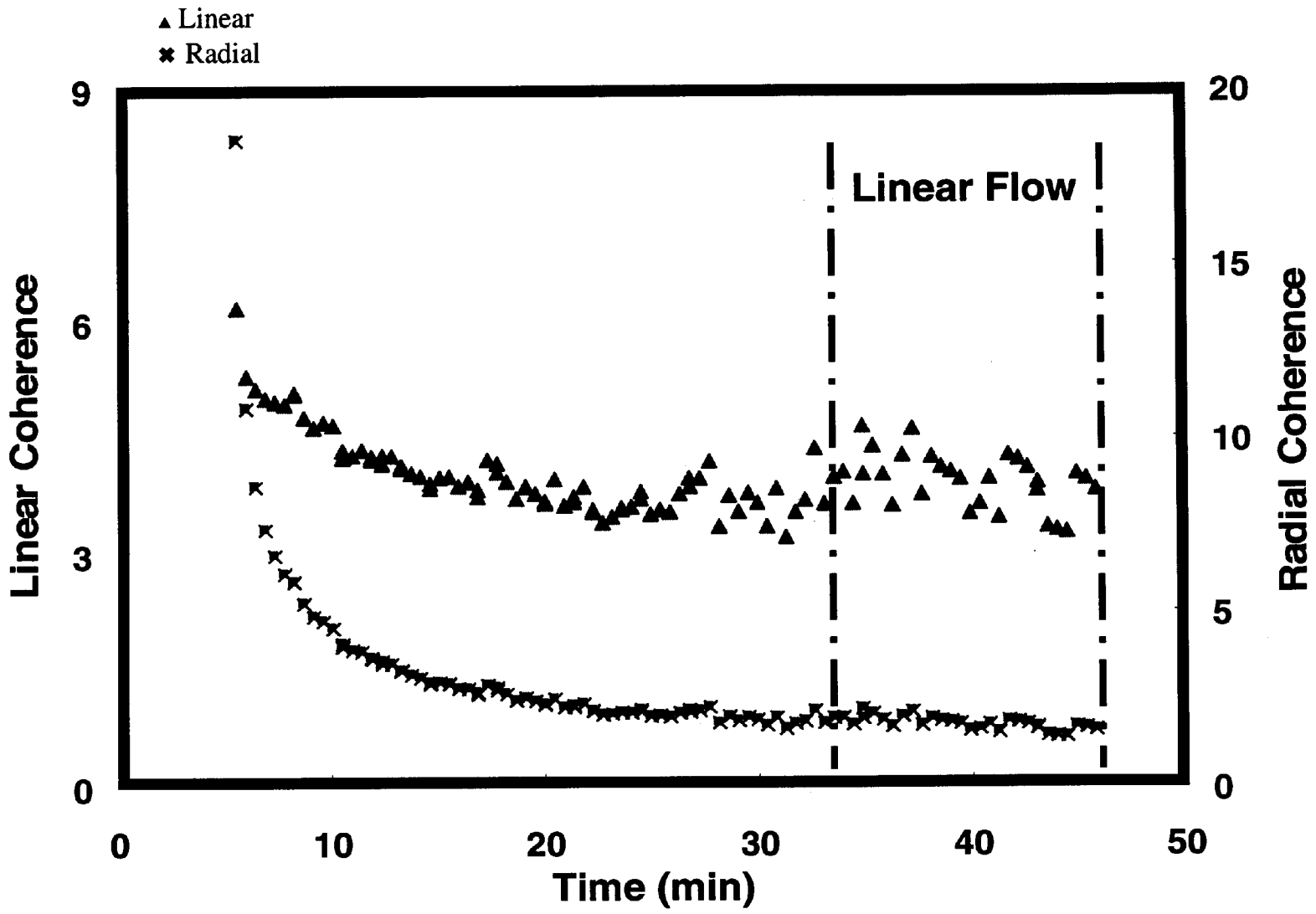
FIG. 21 A FLID plot.
Figure 22:
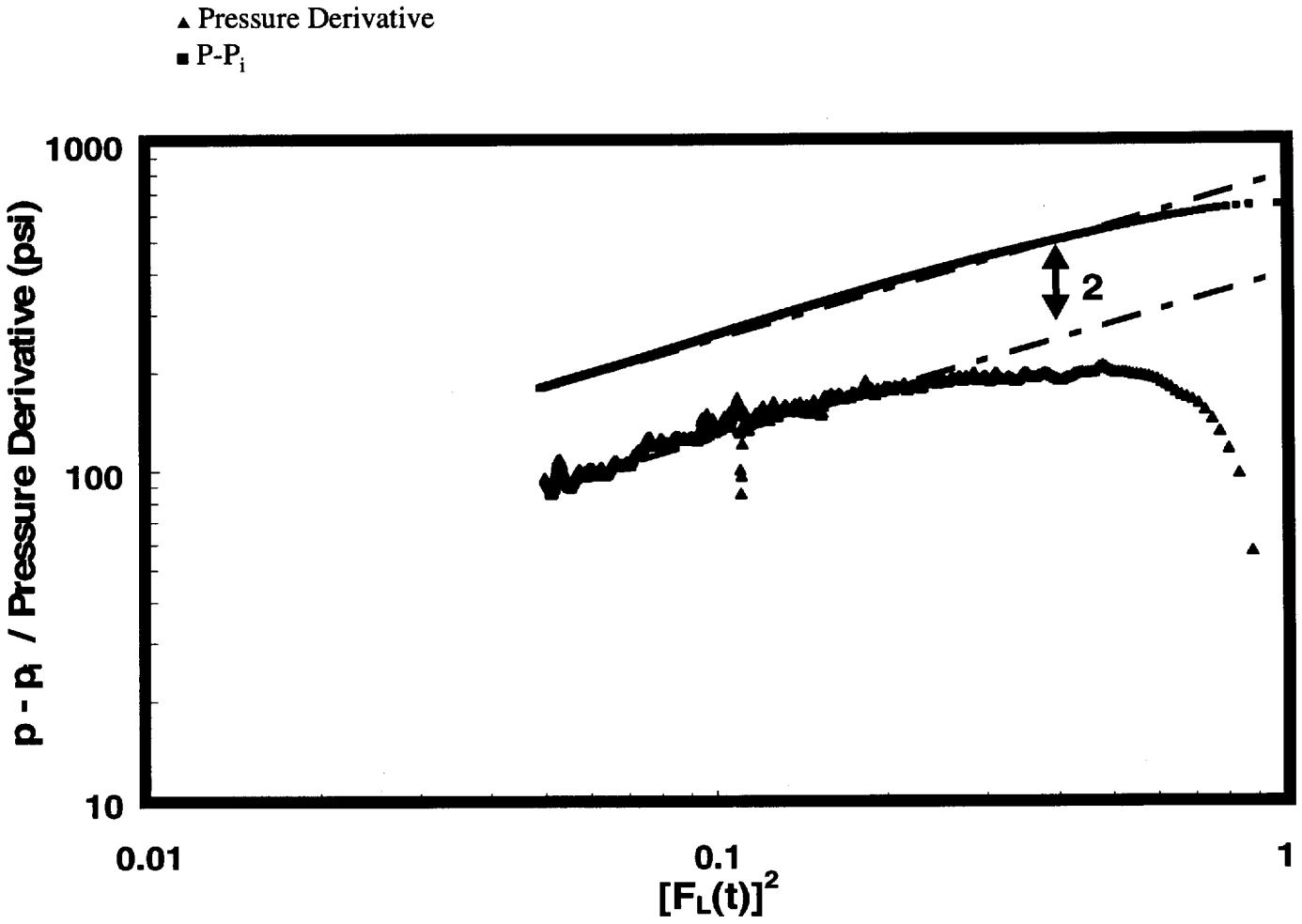
FIG. 22 a Reservoir Diagnostic Plot.

As usual, pressure-decline as a function of time is monitored after shut-in following the minifrac. The corresponding diagnostic plot is shown in FIG. 21. The region between the two vertical broken lines evidences a robust region of linear flow. This is confirmed by the pressure-derivative analysis, presented in FIG. 22. Moreover, the initial pressure of 3724 obtained from this analysis is in excellent agreement with the wholly independent assessment of the reservoir pressure 3726, that is established as the stabilized pressure measurement prior to any injection on the bottomhole gage (FIG. 18).

As in the previous example, the occurrence of radial flow could be erroneously inferred during this period. The occurrence of pseudo-radial flow, was eliminated, however, by observing that the corresponding reservoir pressure of 3310 psi does not reflect the independently established reservoir pressure of 3726 psi. As before, FIG. 22 also illustrates that non-ideal effects due to wellbore gel heat-up during shut-in could have occurred in this example as well.

Figure 23:
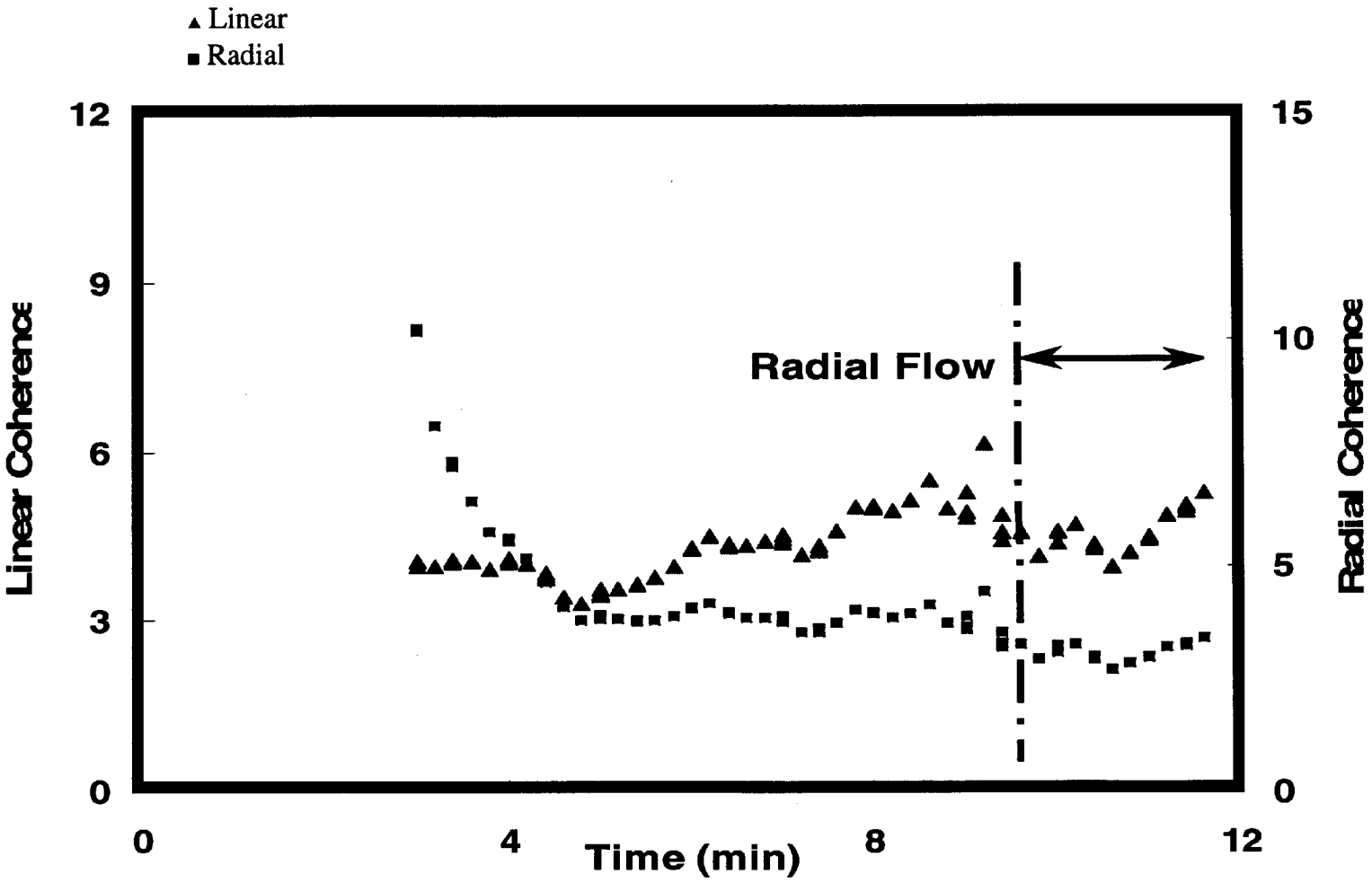
FIG. 23 a FLID plot.
Figure 24:
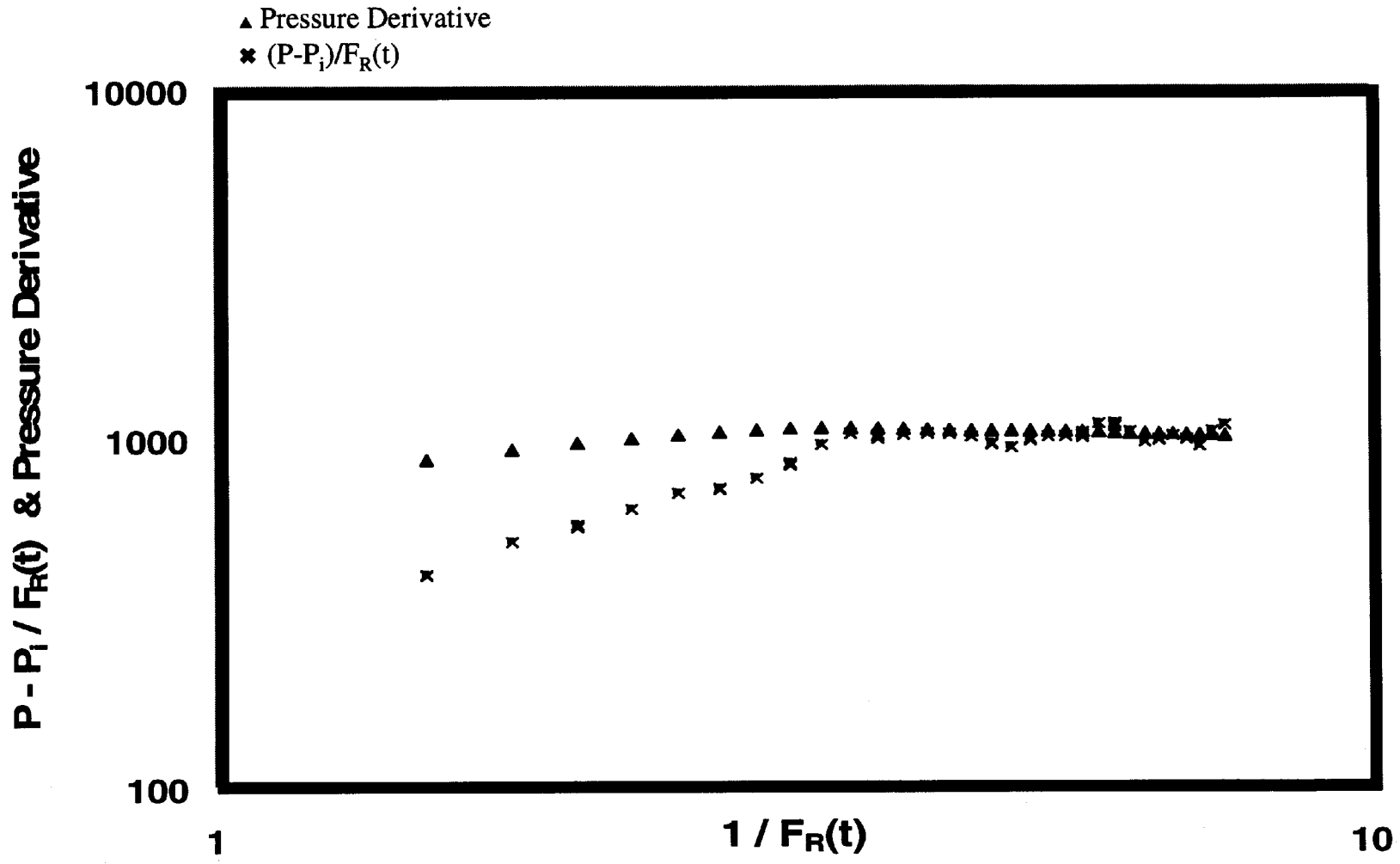
FIG. 24 a Reservoir Diagnostic Plot.
Figure 25:
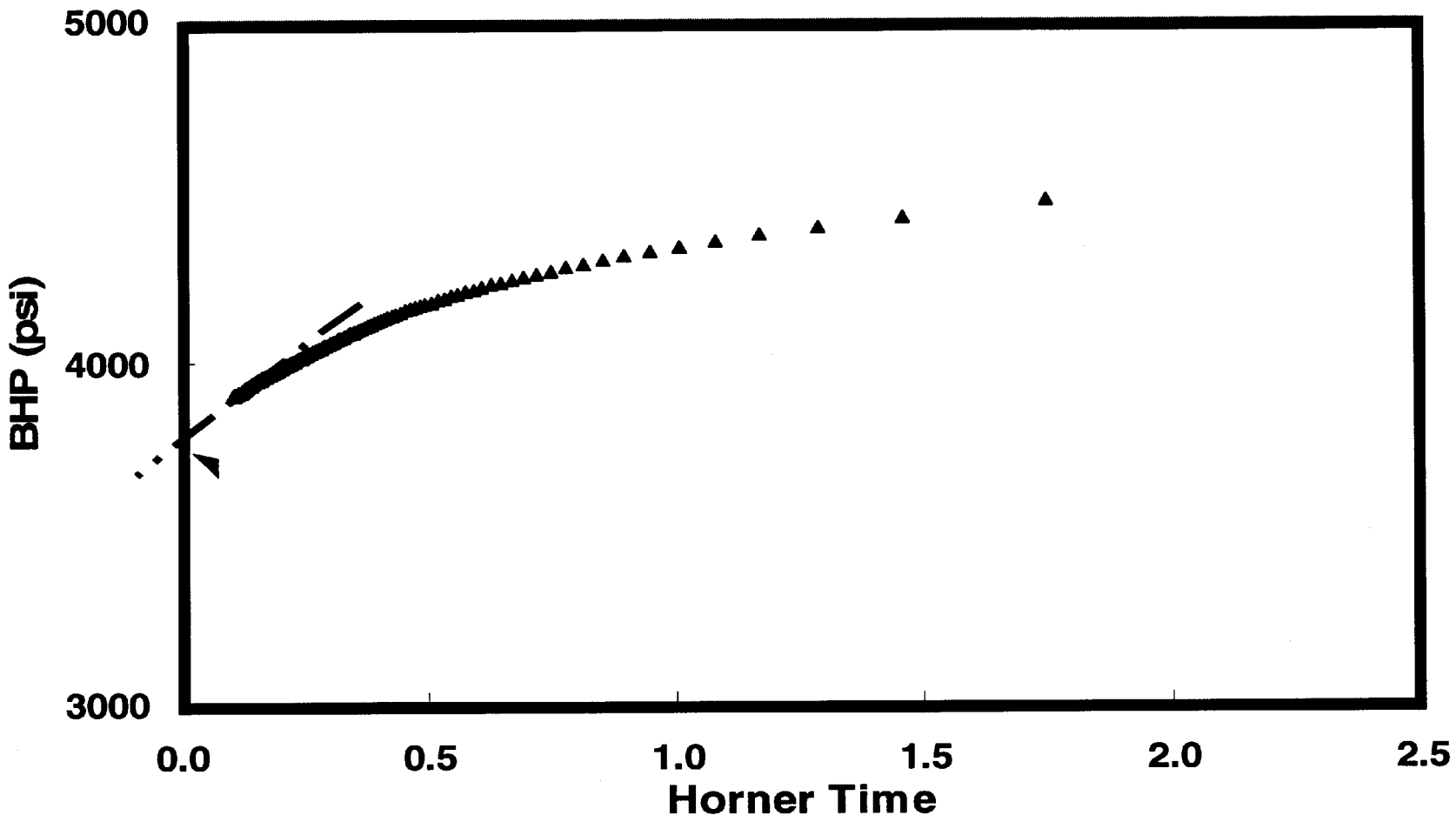
FIG. 25 a Homer-analysis plot.

Next, the radial flow parameters are obtained. Post-closure radial flow is observed from the impulse test, as evidenced by the diagnostic plot show in FIG. 23. The occurrence of radial flow is further verified by the diagnostic pressure-derivative plot shown in FIG. 24. Then, the reservoir pressure is estimated at 3727 psi from the Horner analysis in FIG. 25. This value is consistent with the value determined previously during the linear flow analysis (3726 psi). Finally, the formation transmissibility (in mD-ft/cp) is calculated from the following equation:

$$\frac{kh}{\mu} = \frac{250{,}000\ V_i}{m_r t_c}$$

as 1455 mD ft/cp, where $V_i$ is in barrels (bbl), $m_r$ is in psi, and $t_c$ is in minutes. Note that the closure time is to be defaulted to the pump time if no fracturing of the formation takes place.

Using these parameters, the fracture length from the minifrac is determined to be 30 ft., based on the following equation:

$$x_f = \sqrt{t_{knee}\pi\gamma}\,\frac{1}{f_x}$$

$$\text{where } f_x = \frac{f_c + f_k}{1 + f_k}$$

and $y = k/(\phi\mu c_t)$

The fracture length estimate of 30 ft. is based on a reservoir transmissibility value of 1455 mD ft/cp determined from the radial flow analysis and the slope on the specialized plot during the linear flow, $m_L$, of 822 psi, obtained from the following equation:

$$p(t)-p_i=m_L F_L(t,t_c)$$

Next, the pressure-decline analysis predicts a fluid efficiency value of 22%. In addition, a fluid-loss coefficient of $1.3\times10^{-2}$ ft/min$^{1/2}$ is obtained from the ¾ rule pressure-decline analysis. The fracture length is then determined by be 27 ft. This length estimate, obtained by the pressure-decline analysis, is in excellent agreement with that obtained from the after-closure analysis and confirms the validity of the calibration treatment evaluation.

What is claimed is:

1. In a method for optimal design of a hydraulic fracture in a hydrocarbon-bearing zone, wherein the improvement comprises determining fluid leak-off due to spurt, κ, according to the expression:

$$\kappa = 1 + \frac{4}{\pi}\left[\frac{m_L C_R}{\Delta P_T C_T} - 1\right]\sqrt{t_c/t_p}\,.$$

2. The method of claim 1 comprising the additional step of determining fluid efficiency according to the following expression:

$$\eta = \frac{G^*}{2\kappa + G^*}$$

wherein G* is the value of a pressure decline function at fracture closure.

3. The method of claim 2 comprising the additional step of determining an optimal pad fraction according to the following expression $$f_{pad}(\eta,\kappa)=f_{pad}(\eta_c,\kappa=1)+f_{L\kappa}$$

wherein $$f_{L\kappa} = \frac{(\kappa-1)(1-\eta)}{\kappa}$$

$$f_{pad}(\eta_c, \kappa = 1) = (1-\eta_c)^2$$

$$\eta_c = \frac{(\kappa-1)+\eta}{\kappa}.$$

4. The method of claim 2 comprising the additional step of determining an optimal proppant schedule, for non-TSOT design, according to the following expression:

$$f_v(t) = f_{v,\max}\left[\frac{(t/t_p) - f_{pad}}{1 - f_{pad}}\right]^{\varepsilon}$$

$$\text{wherein } \varepsilon = \frac{1 - f_{pad} - \eta}{\eta}.$$

5. The method of claim 4 comprising the addition step of determining an optimal pad fraction, for TSOT design, according to the following expression:

$$\eta_p = \frac{\eta_{so}}{1+\Delta t_D}\,\frac{V_F(\Delta t_D)}{V_{fSO}}$$

$$\text{wherein } \Delta t_D = \frac{t_p - t_{so}}{t_{so}}.$$

6. The method of claim 2 comprising the additional step of determining fracture length, $x_f$, for a geometry-dependent fracture, according to the following expression:

$$x_f = \frac{(1-\eta)V_i}{2\pi\kappa h_f C_T\sqrt{t_p}}.$$

7. The method of claim 2 comprising the additional step of determining fracture length, $x_f$, for a diffusivity-dependent fracture, according to the following expression:

$$x_f = \frac{\sqrt{\pi\gamma t_{knee}}}{f_x}.$$

8. A device comprising a pre-recorded computer-readable means, said means selected from the group consisting of a magnetic tape, a magnetic disk, an optical disk, a CD-ROM, and a DVD-ROM, wherein said device carries instructions for a process, said process comprising determining fracturing fluid leak-off due to spurt, κ, according to the expression:

$$\kappa = 1 + \frac{4}{\pi}\left[\frac{m_L C_R}{\Delta P_T C_T} - 1\right]\sqrt{t_c/t_p}\,.$$

9. The device of claim 8 wherein said process comprises the additional step of determining fluid efficiency according to the following expression:

$$\eta = \frac{G^*}{2\kappa + G^*}$$

wherein G* is the value of a pressure decline function at fracture closure.

10. The device of claim 8 wherein said process comprises the additional step of determining an optimal pad fraction according to the following expression:

$$f_{pad}(\eta, \kappa) = \frac{(\kappa-1)(1-\eta)}{\kappa} + (1-\eta_c)^2.$$

11. The device of claim 8 wherein said process comprises the additional step of determining an optimal proppant schedule according to the following expression:

$$f_v(t) = f_{v,\max}\left[\frac{(t/t_p) - f_{pad}}{1 - f_{pad}}\right]^{\varepsilon}.$$

12. The device of claim 8 wherein said process comprises the additional step of determining an optimal pad fraction in instances in which tip screen out is desired according to the following expression:

$$\eta_P = \frac{\eta_{so}}{1+\Delta t_D}\frac{V_F(\Delta t_D)}{V_{f,SO}}$$

wherein $\Delta t_D = \frac{t_p - t_{so}}{t_{so}}$.

13. The device of claim 8 wherein said process comprises the additional step of determining fracture length, $x_f$, according to the following expression:

$$x_f = \frac{(1-\eta)V_i}{2\pi\kappa h_f C_T\sqrt{t_p}}.$$

14. The device of claim 2 comprising the additional step of determining fracture length, $x_f$, according to the following expression:

$$x_f = \frac{\sqrt{\pi\gamma t_{knee}}}{f_x}.$$

15. A method for designing a fracture in a hydrocarbon-bearing formation comprising determining fluid leak-off into said hydrocarbon-bearing formation at the frontier of a propagating fracture comprising the steps of:

injecting a first fluid into a wellbore and allowing said fluid to penetrate said formation;

verifying a radial flow regime in said formation;

obtaining a first set of pressure-decline data;

determining $m_R$, $p_i$, and $kh/\mu$ from said first set of pressure-decline data;

injecting a second fluid into said wellbore and allowing said fluid to penetrate said formation and cause or extend a fracture in said formation;

verifying a linear flow regime in said formation;

obtaining a second set of pressure-decline data;

determining $m_L$ and $p^*$ from pressure-decline data;

determining $p_c$, $t_c$, and $t_p$;

determining from a priori means, the rock/formation parameters, $c_t$, $h_p$,$\phi$, and E computing $C_T$ according to the following expression:

$$C_T = \frac{2p^*(c_f)}{\pi r_p\sqrt{t_p}}$$

wherein $r_p = h_p/h_f$, computing $C_R$ according to the following expression:

$$C_R = \Delta P_T\sqrt{\frac{k\phi c_t}{\mu\pi}}$$

wherein $\Delta P_T = p_c - p_i$, and computing spurt, $\kappa$, according to the following expression:

$$\kappa = 1 + \frac{4}{\pi}\left[\frac{m_L C_R}{\Delta P_T C_T} - 1\right]\sqrt{t_c/t_p}.$$

16. The method of claim 15 comprising the additional step of computing a spurt coefficient, $S_p$, according to the following expression:

$$S_p = (\kappa - 1)g_o C_T\sqrt{t_p}$$

wherein $g_o$ is about $\pi/2$.

17. The method of claim 16 comprising the additional step of computing fracture efficiency, $\eta$, according to the following expression:

$$\eta = \frac{G^*}{2\kappa + G^*}$$

wherein $G^*$ is the value of a pressure-decline function at fracture closure.

18. A device comprising a pre-recorded computer-readable means, said device carrying instructions for a process, said process comprising determining the amount of fracturing fluid lost at the frontier of a propagating fracture deliberately created in a subterranean hydrocarbon-bearing formation, determined by the combination of parameters: $m_L$, $C_R$, $p_c - p_i$, $C_T$, $t_c$, and $t_p$.

19. A device comprising a pre-recorded computer-readable means, said device carrying instructions for a process, said process comprising determining the amount of fracturing fluid lost at the frontier of a propagating fracture deliberately created in a subterranean hydrocarbon-bearing formation, determined in part by a value of linear flow slope, $m_L$, that satisfies the following expression:

$$p(t) - p_i = m_L F_L(t, t_c).$$

20. A device comprising a pre-recorded computer-readable means, said device carrying instructions for a process, said process comprising determining the amount of fracturing fluid lost at the frontier of a propagating fracture deliberately created in a subterranean hydrocarbon-bearing formation, comprising the step of determining closure time, according to the following expression:

$$\frac{p(t_2) - p_i}{p(t_1) - p_i} = \frac{F_L(t_2, t_c)}{F_L(t_1, t_c)}.$$

21. A device comprising a pre-recorded computer-readable means, said device carrying instructions for a process, said process comprising determining the amount of fracturing fluid lost at the frontier of a propagating fracture deliberately created in a subterranean hydrocarbon-bearing formation, by obtaining a correction factor to satisfy the following expression, that represents an ideal (non-spurt) condition:

$$p(t) - p_i = C_T\sqrt{\frac{\mu\pi}{k\phi c_i}}\,\frac{2}{\pi}\sin^{-1}\sqrt{\frac{t_c}{t}}$$

such that $t \geqq t_c$.

22. A device comprising a pre-recorded computer-readable means, said device carrying instructions for a process, said process comprising determining the amount of fracturing fluid lost at the frontier of a propagating fracture deliberately created in a subterranean hydrocarbon-bearing formation, determined in part by the following expression:

$$\hat{F}(t) = (1 + f_\kappa)F_L(t)$$

wherein $$f_\kappa = \frac{\pi}{4}\frac{(\kappa-1)}{\sqrt{t_c/t_p}}.$$

23. A device comprising a pre-recorded computer-readable means, said device carrying instructions for a process, said process comprising determining the amount of fracturing fluid lost at the frontier of a propagating fracture deliberately created in a subterranean hydrocarbon-bearing formation, based, in essential part, upon the following expression:

$$F_L(t, t_c) = \frac{2}{\pi}\sin^{-1}\sqrt{\frac{t_c}{t}}$$

wherein $t \geqq t_c$.

24. A system for fracturing a subterranean hydrocarbon-bearing formation comprising first determining the proper amount of pad fluid and proppant based on fluid efficiency, comprising:

means for performing a first injection event;

means for monitoring and recording a first set of pressure-decline data from a first injection event;

means for minimizing fluid-loss from a wellbore into said formation, after said first injection event;

means for normalizing said first set of pressure-decline data;

means for verifying a radial flow regime;

means for determining $p_i$, $m_r$, and $kh/\mu$ from said normalized first set of pressure-decline data;

means for performing a second injection event to fracture said formation;

means for monitoring and recording a second set of pressure-decline data from a second injection event;

means for minimizing fluid loss from a wellbore into said formation, after said second injection event;

means for normalizing said second set of pressure-decline data;

means for verifying a linear flow regime;

means for determining $t_c$, $m_L$, $p^*$, and $p_c$ from said second set of pressure decline data;

means for recording $t_p$;

means for storing rock/formation parameters,, $c_t$, $h_p$, $\phi$, and E;

means for computing $C_T$ according to the following expression:

$$C_T = \frac{2p^*(c_f)}{\pi r_p\sqrt{t_p}}$$

wherein $r_p = h_p/h_f$, and $c_f$ which is a function of $E/(h_f)^2$ means for computing $C_R$ according to the following expression:

$$C_R = \Delta P_T\sqrt{\frac{k\phi c_t}{\mu\pi}}$$

wherein $\Delta P_T = p_c - p_i$, means for computing spurt, $\kappa$, according to the following expression:

$$\kappa = 1 + \frac{4}{\pi}\left[\frac{m_L C_R}{\Delta P_T C_T} - 1\right]\sqrt{t_c/t_p}$$

means for computing a spurt coefficient, $S_p$, according to the following expression:

$$S_p = (\kappa-1)g_o C_T\sqrt{t_p}$$

wherein $g_o$ is about $\pi/2$, and means for computing fluid efficiency, $\eta$, according to the following expression:

$$\eta = \frac{G^*}{2\kappa + G^*}$$

wherein $G^*$ is the value of a decline function at fracture closure.

25. A system for fracturing a subterranean hydrocarbon-bearing formation comprising first determining the proper amount of pad fluid and proppant based on fluid efficiency, comprising the steps of:

obtaining pressure-decline data;

calculating ideal fluid loss, in the absence of leak-off at the propagating fracture frontier, based essentially on the following expression:

$$F_L(t, t_c) = \frac{2}{\pi}\sin^{-1}\sqrt{\frac{t_c}{t}};$$

determining actual fluid loss from said pressure decline data;

comparing said ideal fluid loss and actual fluid loss; thereafter formulating a correction to account for said leak-off at the propagating fracture frontier.

26. In a fracturing operation wherein the pad fraction and proppant schedule are determined based on fluid efficiency, said fluid efficiency in turn determined from leak-off coefficient, and said leak-off coefficient determined from spurt, an article of manufacture comprising a medium that is readable by computer and that carries instructions for said computer to perform a process comprising the steps of:

determining $p_i$, $kh/\mu$, and $m_r$ from pressure-decline data;

determining $m_L$ and $p^*$ from pressure-decline data;

determining $p_c$, $t_c$, and $t_p$;

determining from a priori means, the rock/formation parameters, $c_t$, $h_p$, $\phi$, and E computing $C_T$ according to the following expression:

$$C_T = \frac{2p^*(c_f)}{\pi r_p\sqrt{t_p}}$$

wherein $r_p = h_p/h_f$, computing $C_R$ according to the following expression:

$$C_R = \Delta P_T \sqrt{\frac{k\phi c_t}{\mu\pi}}$$

wherein $\Delta P_T = p_c - p_i$, computing spurt, κ, according to the following expression:

$$\kappa = 1 + \frac{4}{\pi}\left[\frac{m_L C_R}{\Delta P_T C_T} - 1\right]\sqrt{t_c/t_p}$$

computing a spurt coefficient, $S_p$, according to the following expression:

$$S_p = (\kappa - 1) g_o C_T \sqrt{t_p}$$

wherein $g_o$ is about π/2, and computing fracture efficiency, η, according to the following expression:

$$\eta = \frac{G^*}{2\kappa + G^*}$$

wherein G* is the value of a decline function at fracture closure.

27. A device comprising a pre-recorded computer-readable means, said device carrying instructions for a process comprising the steps of:

recording a first set of pressure-decline data from a first injection event;

normalizing said first set of pressure-decline data;

verifying a radial flow regime;

determining $p_i$, $m_r$, and $kh/\mu$ from said normalized first set of pressure-decline data;

recording a second set of pressure-decline data from a second injection event;

normalizing said second set of pressure-decline data;

verifying a linear flow regime;

determining $t_c$, $m_L$, p*, and $p_c$ from said second set of pressure decline data;

recording $t_c$;

storing rock/formation parameters,, $c_t$, $h_p$, φ, and E computing $C_T$ according to the following expression:

$$C_T = \frac{2p^*(c_f)}{\pi r_p \sqrt{t_p}}$$

wherein $r_p = h_p/h_f$, and $c_f$ is a function of $E/h_f^2$ computing $C_R$ according to the following expression:

$$C_R = \Delta P_T \sqrt{\frac{k\phi c_t}{\mu\pi}}$$

wherein $\Delta P_T = p_c - p_i$, computing spurt, κ, according to the following expression:

$$\kappa = \frac{4}{\pi}\left[\frac{m_L C_R}{\Delta P_T C_T} - 1\right]\sqrt{t_c/t_p}$$

computing a spurt coefficient, $S_p$, according to the following expression:

$$S_p = (\kappa - 1) g_o C_T \sqrt{t_p}$$

wherein $g_o$ is about π/2, and computing fluid efficiency, η, according to the following expression:

$$\eta = \frac{G^*}{2\kappa + G^*}$$

wherein G* is the value of a decline function at fracture closure.

28. The device of claim 27 wherein said process comprises the addition step of determining fracture length, $x_f$, for a geometry-dependent fracture, according to the following expression:

$$x_f = \frac{(1-\eta)V_i}{2\pi\kappa h_f C_T \sqrt{t_p}}$$

wherein $V_i$ is the volume of fluid injected during said second injection event.

29. The device of claim 27 wherein said process comprises the additional step of determining fracture length, $x_f$, for a diffusivity-dependent fracture, according to the following expression:

$$x_f = \frac{\sqrt{\pi\gamma t_{knee}}}{f_x}$$

wherein $t_{knee} = (4/\pi^2)(t_c)(m_r/m_L)^2$ wherein $$\gamma = \frac{k/\mu}{c_t\phi};$$

and wherein $f_x$ is an apparent-length correction factor.

30. The device of claim 27 wherein said process comprises the additional step of determining the optimal pad fraction based on fluid loss due to spurt.

31. The device of claim 27 wherein said pad fraction is determined according to the following expression:

$$f_{pad}(\eta, \kappa) = \frac{(\kappa - 1)(1 - \eta)}{\kappa} + (1 - \eta_c)^2.$$

32. The device of claim 27 wherein said process comprises the addition step of determining the optimal proppant schedule.

33. The device of claim 27 wherein said proppant schedule is determined according to the following expression:

$$f_v(t) = f_{v,\max}\left[\frac{(t/t_p) - f_{pad}}{1 - f_{pad}}\right]^{\varepsilon}$$

wherein $\varepsilon = \frac{1 - f_{pad} - \eta}{\eta}$.

34. The device of claim 27 wherein said process comprises the addition step of determining the optimal pad fraction, in cases in which tip screen out is desired, according to the following expression:

$$\eta_P = \frac{\eta_{SO}}{1 + \Delta t_D}\,\frac{V_F(\Delta tD)}{V_{f,SO}}$$

wherein $\Delta t_D = \frac{t_P - t_{so}}{t_{so}}$.

35. The device of claim 27 wherein said pre-recorded computer-readable means is selected from the group consisting of a magnetic tape, a magnetic disk, an optical disk, a CD-ROM, and a DVD.

36. The device of claim 27 wherein said pre-recorded computer-readable means is a CD-ROM.

37. A method for determining fracture fluid leak-off at a propagating fracture frontier, according to the following steps:

obtaining pressure-decline data;

calculating ideal fluid loss, in the absence of leak-off at the propagating fracture frontier, based essentially on the following expression:

$$F_L(t, t_c) = \frac{2}{\pi}\sin^{-1}\sqrt{\frac{t_c}{t}};$$

determining actual fluid loss from said pressure decline data;

comparing said ideal fluid loss and actual fluid loss; thereafter formulating a correction to account for said leak-off at the propagating fracture frontier.

38. A device comprising a pre-recorded computer-readable means, said means selected from the group consisting of a magnetic tape, a magnetic disk, an optical disk, a CD-ROM, and a DVD-ROM, wherein said device carries instructions for a process, said process comprising determining fracture fluid leak-off at the propagating fracture frontier, according to the following steps:

monitoring pressure-decline data from a first injection event;

monitoring pressure-decline data from a second injection event; and calculating fluid leak-off at the propagating fracture frontier, from each said data from said first and said second injection events.

39. A method for determining fluid loss at a frontier of a propagating fracture, comprising the steps of:

obtaining pressure-decline data from at least one injection event;

determining a linear flow slope from pressure-decline data obtained during a linear flow regime; and determining transmissibility from pressure-decline data obtained during a radial flow regime.

40. A device comprising a pre-recorded computer-readable means, said means selected from the group consisting of a magnetic tape, a magnetic disk, an optical disk, a CD-ROM, and a DVD-ROM, wherein said device carries instructions for a process, said process comprising determining fracture fluid leak-off at a propagating fracture frontier, according to the following steps:

obtaining pressure-decline data;

calculating ideal fluid loss, in the absence of leak-off at the propagating fracture frontier, based on the following expression:

$$F_L(t, t_c) = \frac{2}{\pi}\sin^{-1}\sqrt{\frac{t_c}{t}};$$

determining actual fluid loss from said pressure decline data;

comparing said ideal fluid loss and actual fluid loss; thereafter formulating a correction to account for said leak-off at the propagating fracture frontier.

41. A device comprising a pre-recorded computer-readable means, said means selected from the group consisting of a magnetic tape, a magnetic disk, an optical disk, a CD-ROM, and a DVD-ROM, wherein said device carries instructions for a process, said process comprising determining fracture fluid leak-off at a propagating fracture frontier, according to the following steps:

monitoring pressure-decline data from a first injection event;

monitoring pressure-decline data from a second injection event; and calculating fluid leak-off at the propagating fracture frontier, from each said data from said first and said second injection event.

42. A device comprising a pre-recorded computer-readable means, said means selected from the group consisting of a magnetic tape, a magnetic disk, an optical disk, a CD-ROM, and a DVD-ROM, wherein said device carries instructions for a process, said process comprising determining fracture fluid leak-off at a propagating fracture frontier, according to the following steps:

obtaining pressure-decline data;

calculating ideal fluid loss, in the absence of leak-off at the propagating fracture frontier, based on the an expression derived by comparison of linear flow across a fracture face to heat transfer from a semi-infinite surface into a diffusive medium;

determining actual fluid loss from said pressure decline data;

comparing said ideal fluid loss and actual fluid loss; thereafter formulating a correction to account for said leak-off at the propagating fracture frontier.

43. A device comprising a pre-recorded computer readable means, said means selected from the group consisting of a magnetic tape, a magnetic disk, an optical disk, a CD-ROM, and a DVD-ROM, wherein said device carries instructions for a process, said process comprising the method of claim 39.

44. The device of claim 43 wherein said process comprises the additional steps of:

determining a fracture length;

verifying a value of closure pressure based on said determined fracture length.

45. A method for creating a fracture in a subsurface hydrocarbon-bearing formation, comprising first determining an optimal pad fraction and a proppant fraction, wherein said fractions are determined based on an efficiency value in turn determined by calculating fluid loss due to spurt by:

obtaining pressure-decline data from at least one injection event;

determining a linear flow slope from pressure-decline data obtained during a linear flow regime; and determining transmissibility from pressure-decline data obtained during a radial flow regime.

46. The method of claim 45 comprising the additional step of determining fluid-loss due to spurt from said linear flow slope and said transmissibility.

47. The method of claim 46 comprising the additional step of determining fracture length according to the following expression:

$$x_f = \frac{(1-\eta)V_i}{2\pi\kappa h_f C_T \sqrt{t_p}}.$$

48. The method of claim 46 comprising the additional step of determining fracture length according to the following expression:

$$x_f = \frac{\sqrt{\pi \gamma t_{knee}}}{f_x}.$$

49. The method of claim 47 comprising the additional step of verifying one or more parameters used to determine spurt based on an independent determination of fracture length.

50. The method of claim 48 comprising the additional step of verifying one or more parameters used to determine spurt based on an independent determination of fracture length.

51. The method of claim 46 comprising the additional step of determining an optimal pad fraction and proppant schedule.

52. The method of claim 6 comprising the additional step of verifying fracture compliance using fracture length.

53. The method of claim 7 comprising the additional step of verifying fracture compliance using fracture length.

54. The device of claim 13 wherein said process comprises the additional step of verifying fracture compliance using fracture length.

55. The device of claim 14 wherein said process comprises the additional step of verifying fracture compliance using fracture length.

* * * * *